US011986725B2

(12) United States Patent
Hu

(10) Patent No.: US 11,986,725 B2
(45) Date of Patent: May 21, 2024

(54) POKER MACHINE, POKER CARD TURNING MECHANISM, CARD DEALER AND POKER CARD SORTING METHOD

(71) Applicant: ZHEJIANG XUANHE ELECTROMECHANICAL TECHNOLOGY CO., LTD., Zhejiang (CN)

(72) Inventor: Quxian Hu, Zhejiang (CN)

(73) Assignee: ZHEJIANG XUANHE ELECTROMECHANICAL TECHNOLOGY CO., LTD., Zhejiang (CN)

( * ) Notice: Subject to any disclaimer, the term of this patent is extended or adjusted under 35 U.S.C. 154(b) by 500 days.

(21) Appl. No.: 17/285,487

(22) PCT Filed: Oct. 14, 2019

(86) PCT No.: PCT/CN2019/110998
§ 371 (c)(1),
(2) Date: Apr. 15, 2021

(87) PCT Pub. No.: WO2020/078311
PCT Pub. Date: Apr. 23, 2020

(65) Prior Publication Data

US 2021/0387080 A1 Dec. 16, 2021

(30) Foreign Application Priority Data

Oct. 15, 2018 (CN) ..... 201811198400.2
Dec. 14, 2018 (CN) ..... 201811533440.8

(51) Int. Cl.
*A63F 1/14* (2006.01)
*A63F 1/12* (2006.01)
*A63F 1/00* (2006.01)

(52) U.S. Cl.
CPC ..... *A63F 1/14* (2013.01); *A63F 1/12* (2013.01); *A63F 2001/005* (2013.01)

(58) Field of Classification Search
CPC ..... A63F 1/12; A63F 1/14
See application file for complete search history.

(56) References Cited

U.S. PATENT DOCUMENTS

2013/0106054 A1 5/2013 Tseng

FOREIGN PATENT DOCUMENTS

CN 201164714 12/2008
CN 102029060 4/2011
(Continued)

OTHER PUBLICATIONS

English machine translation of Luo (CN-107875624-A) (Year: 2018).*

(Continued)

*Primary Examiner* — Laura Davison
(74) *Attorney, Agent, or Firm* — JCIPRNET

(57) ABSTRACT

A poker machine, a poker card turning mechanism, a card dealer and a poker card sorting method are provided. A first card discharging passage is formed between a card turning wheel and a first card discharge pressing wheel. A card turning passage is formed between the card turning wheel and the card turning pressing wheel. A second card discharging passage is formed between the card turning pressing wheel and the second card discharge pressing wheel. The card turning passage extends along part of the arc circumference of the card turning wheel from one side of the card turning wheel to the other side of the card turning wheel. A card turning component for opening or closing the outlet of the first card discharging passage is provided outside the card turning passage.

10 Claims, 13 Drawing Sheets

(56) References Cited

FOREIGN PATENT DOCUMENTS

| | | | | | |
|---|---|---|---|---|---|
| CN | 102580307 | | | 7/2012 | |
| CN | 103055499 | | | 4/2013 | |
| CN | 103990271 | | | 8/2014 | |
| CN | 103157272 | | | 4/2015 | |
| CN | 105854274 | | | 8/2016 | |
| CN | 105879373 | | | 8/2016 | |
| CN | 107096215 | | | 8/2017 | |
| CN | 107875624 | A | * | 4/2018 | ..... A63F 1/12 |
| CN | 207627880 | | | 7/2018 | |
| CN | 108525278 | | | 9/2018 | |
| CN | 109350955 | | | 2/2019 | |
| CN | 110193184 | | | 9/2019 | |
| CN | 209405638 | | | 9/2019 | |
| CN | 209405640 | | | 9/2019 | |
| CN | 209405641 | | | 9/2019 | |
| CN | 209405642 | | | 9/2019 | |
| CN | 209405643 | | | 9/2019 | |
| CN | 209405644 | | | 9/2019 | |
| CN | 209405645 | | | 9/2019 | |
| CN | 209490456 | | | 10/2019 | |

OTHER PUBLICATIONS

"International Search Report (Form PCT/ISA/210) of PCT/CN2019/110998," dated Jan. 6, 2020, with English translation thereof, pp. 1-6.

* cited by examiner

POKER MACHINE, POKER CARD TURNING MECHANISM, CARD DEALER AND POKER CARD SORTING METHOD

CROSS-REFERENCE TO RELATED APPLICATION

This application is a 371 of international application of PCT application serial no. PCT/CN2019/110998, filed on Oct. 14, 2019, which claims the priority benefit of China application no. 201811198400.2 filed on Oct. 15, 2018, and no. 201811533440.8 filed on Dec. 14, 2018.

BACKGROUND

Technical Field

The disclosure relates to a field of poker machines, and in particular, relates to a poker machine, a poker card turning mechanism, a card dealer, and a poker card sorting method.

Description of Related Art

Playing card is a kind of entertainment that people love. After each round is finished, players need to sort, shuffle and deal cards by themselves. In order to save the time of dealing cards, automatic card dealers have been invented to deal cards. For example, a patent publication of CN201164714Y discloses a four-opening playing card dealing machine, which has a card-arranging cavity. The center of the card-arranging cavity is provided with a card-arranging differential mechanism driven by a card-arranging electric motor, and the circumference of the card-arranging differential mechanism is evenly distributed with four conveying belts connected to a card-dealing mechanism. The conveying belts are driven by a conveying electric motor, one side of each conveying belt is provided with a card-arranging wheel, and the other side of each conveying belt is provided with a stop block matched with the card-arranging wheel which is provided with a spiral deflector rod. The output end of the card-dealing mechanism is provided with a counting optical eye. When the card-dealing machine is in use, messy cards are placed in the card-arranging cavity with their front sides facing downward. The cards are dealt from the four openings after being processed through the card-arranging differential mechanism, the card-arranging wheel, and the card-dealing mechanism. Although the card-dealing machine basically completes the card-shuffling action and card-dealing action, it is inevitable that the players need to collect, organize and flip over the playing cards whose front side and rear side do not face the same direction. As a result, a lot of labor is required during the game, and the waiting time is increased.

A patent publication of CN102580307A discloses a full-automatic poker machine, which includes a mounting bottom plate and a plurality of support legs arranged at the bottom portion of the mounting bottom plate. The mounting bottom plate is provided with a card inlet arranged in the manner of opening in parallel with the table for placing the playing cards, a card cutting and primary card distributing equipment arranged at one end of the card inlet and configured to separate the messy cards primarily, a card sorting and secondary card distributing equipment arranged at the other end of the card cutting and primary card distributing equipment and configured to arrange the playing cards to face the same direction and separate them into single pieces, a card turning and dealing equipment disposed at the other end of the card sorting and secondary card distributing equipment, and configured to organize the single pieces of playing cards which do not face the same direction to face the same direction and deal the cards in accordance with rules, and a card pushing equipment arranged at the other end of the card turning and dealing equipment, and configured to move the playing cards which have been dealt. A card lifting equipment is disposed on one side of the card pushing equipment, and is configured to lift the playing cards to the tabletop. Specifically, the card cutting and primary card distributing equipment realizes the primary card distribution by different rotation speeds of the card-inlet belt and card-distributing belt (the playing cards are separated into several sets with a few pieces). The card sorting and secondary card distributing equipment conveys the playing cards by the secondary distributing belt and realizes card sorting by the card-sorting belt and the auxiliary card-sorting belt disposed on both sides (the playing cards are adjusted to face the same direction, that is, organizing the cards). The card turning equipment realizes turning cards by the card-turning plate and three card-turning belts that are recessed downward (the playing cards are flopped to face a direction as required). The card dealing equipment deals cards randomly by the card-dealing belt and the card-dealing rod (that is, the playing cards are shuffled and dealt). The playing cards that are dealt directly fall on the card-pushing panel and then pushed to the card-lifting panel by the card-pushing rod, and the card lifting equipment lifts the playing cards to the desktop of the game table.

Although the above-mentioned playing card machine basically realizes the actions of sorting, shuffling and dealing cards, they have the following problems due to their structural limitations.

1. The playing cards are easily jammed in the gap between the conveyor belt and the surrounding walls, which may easily cause damage to playing cards, jamming or equipment failure.

2. The playing cards are placed flat on the conveyor belt, and the playing cards are rotated and adjusted in the horizontal plane through the opposite movement of the card sorting belts on both sides, so that the playing cards can be sorted horizontally. However, such design can easily cause the playing cards to float and jammed between the card sorting belts on both sides, and even the playing cards can be damaged or jammed in the gap of the belts. Moreover, there is high requirement for the conveying speed and length of the conveyor belt, and therefore the card sorting efficiency is low.

3. The card turning plate and three card turning belts are cooperated to flop the playing cards. Such design has the shortcomings that the cards cannot be flopped in a stable manner, and the card turning efficiency is low. Meanwhile, the drawback of cards jamming in the gap of the belts still exists.

4. The plurality of card-dealing openings are arranged by using the card dealing belt and straight lines. Such design has the shortcomings that the cards cannot be dealt in a stable manner, and the card dealing efficiency is low. Moreover, the playing cards at multiple positions are lifted at the same position, which makes it inconvenient for the players to take the cards, and the chance of cheating may be increased.

A patent publication of CN103055499A discloses a full-automatic poker machine, including a card feeding frame for placing the playing cards, and a card sending mechanism is disposed at the bottom portion of the card feeding frame and configured to convey the playing cards. A card disposing groove is used for placing the playing cards vertically, and at least two playing card disposing devices are disposed in the card disposing groove and they can generate movement relative to each other, so as to move the playing cards so that the playing cards can be moved out of the card disposing groove with vertical long edges. A vertical card transferring device is configured to vertically place the playing cards that are sent by the card feeding frame in the card disposing groove. A card turning device configured to flop the playing cards to face upward or downward, and the card turning device is disposed at the outlet side of the card disposing groove. A card dealing device is disposed at the rear side of the card turning device, and is configured to randomly send the playing cards to multiple card receptor boxes. Multiple card lifting devices are configured to lift the playing cards in various card receptor boxes to the desktop of the game table. The playing card machine adopts normal playing cards and sorts the cards in a vertical manner, which significantly increases the accuracy and efficiency of card sorting. However, there are many components required for the playing card machine and the manufacturing cost is high.

A patent publication of CN105854274A discloses a poker machine and poker card sorting method thereof, which omits the card sorting device and vertical card transferring device. By arranging a card discharging mechanism at the card outlet of the existing card feeding frame, the card discharging mechanism sends out single pieces of cards which are sent to the card turning device to be flopped and dealt. The machine can separate, flop, shuffle and deal a pile of playing cards which have been organized. The machine has high card shuffling efficiency, good reliability, and the manufacturing cost of the machine is low. However, the card turning device of the playing card machine can only send one mahjong tile to the card turning box at a time for identification, turning and dealing. The card turning efficiency is low, and the noise caused by the rotation in the card turning box is loud, the load of motor is large, the structure is complicated, and the stability is poor. Additionally, the arrangement of the structure of the playing card machine is loose, the volume of the machine is large, and the installing efficiency is low.

SUMMARY

Technical Problem

To solve the foregoing problems, the disclosure aims to provide a poker machine, a poker card turning mechanism, a card dealer, and a poker card sorting method in which a card turning passage is disposed to turn playing cards required to be turned, and the unturned and turned playing cards are sent out from two card outlet passages, so that continuous card turning and card distributing may be achieved, and card turning efficiency and card dealing efficiency are significantly improved.

Technical Solutions

To accomplish the foregoing purpose, the following technical solutions are adopted by the disclosure.

A poker card turning mechanism of a poker machine is provided and includes a first card discharge pressing wheel, a card turning wheel, a card turning pressing wheel, and a second card discharge pressing wheel. The card turning wheel is a driving wheel and is driven to be turned by a card turning motor. The first card discharge pressing wheel, the card turning pressing wheel, and the second card discharge pressing wheel are all driven wheels. The first card discharge pressing wheel and the card turning pressing wheel are in rolling contact with the card turning wheel, and the second card discharge pressing wheel and the card turning pressing wheel are in rolling contact. A first card discharging passage is formed between the card turning wheel and the first card discharge pressing wheel, a card turning passage is formed between the card turning wheel and the card turning pressing wheel, and a second card discharging passage is formed between the card turning pressing wheel and the second card discharge pressing wheel. The card turning wheel is installed on an inner side of the card turning passage and is located between the first card discharging passage and the second card discharging passage. The card turning passage extends along part of an arc circumference of the card turning wheel from one side of the card turning wheel close to the first card discharging passage to the other side of the card turning wheel away from the first card discharging passage. A card turning component configured to open or close an outlet of the first card discharging passage is disposed outside the card turning passage. An end of the card turning passage away from the first card discharging passage is provided with a card pushing component. The second card discharging passage is disposed at a position opposite to the card pushing component outside the card turning passage, and the card turning component is driven by a card turning drive mechanism to open or close the first card discharging passage. When the card turning component opens the outlet of the first card discharging passage, a card feeding passage, a delivery passage, and the first card discharging passage are connected in sequence and a playing card is sent out from the first card discharging passage. When the card turning component opens the card turning passage and closes the outlet of the first card discharging passage, the card feeding passage, the delivery passage, the first card discharging passage, the card turning passage, and the second card discharging passage are connected in sequence and the playing card is sent out from the second card discharging passage.

Preferably, each of the card turning wheel, the first card discharge pressing wheel, the card turning pressing wheel, and the second card discharge pressing wheel is a roller part or is formed by a plurality of wheel-shaped parts installed on a same shaft.

Preferably, the card turning component is driven to swing by the card turning drive mechanism to open or close the first card discharging passage. A swing center of the card turning component is located at a center position or an end portion of the card turning component, and an inner side of the card turning component is shaped as an arc shape corresponding to an outer circumference of the card turning wheel.

Preferably, the card turning passage and the second card discharging passage are disposed above or below the first card discharging passage.

Preferably, the card turning drive mechanism driving the card turning component to open or close the outlet of the first card discharging passage is implemented by a motor through a deceleration mechanism or a transmission mechanism.

Preferably, the card turning drive mechanism driving the card turning component to open or close the outlet of the first card discharging passage is an electromagnet. A crank is fixed to an end of a card turning shaft of the card turning component, a swing end of the crank is connected to a movable end of the electromagnet through a connecting rod, and such that the electromagnet pulls the card turning component to swing through the connecting rod and the crank when the card turning component needs to be moved.

Preferably, the first card discharge pressing wheel and/or the card turning pressing wheel elastically press the card turning wheel through respective enabling mechanisms. The card pushing component is an elastic component including a spring, an elastic piece, and an elastic rubber band or is an elastic enabling mechanism formed by a plurality of components. The first card discharge pressing wheel is rotatably installed on a first card discharge pressing wheel frame, the first card discharge pressing wheel frame is hingedly connected to a delivery bottom portion wall of the delivery passage, and a torsion spring is sleeved on a hinge connection shaft to make the first card discharge pressing wheel press the card turning wheel. The second card discharge pressing wheel is installed on a second card discharge pressing wheel frame through an elastic shaft to press the card turning pressing wheel, and a transition wheel is disposed on a side of the second card discharge pressing wheel frame provided with the second card discharge pressing wheel close to the card turning wheel to guide the playing card to be located between the card turning pressing wheel and the second card discharge pressing wheel.

A card dealer of a poker machine is provided and includes the above-mentioned poker card turning mechanism.

A poker machine is provided and includes the above-mentioned card dealer.

A poker card sorting method is provided and includes the above-mentioned poker machine.

Beneficial Effects

The disclosure adopts the above-mentioned technical solutions. When the card turning component opens the outlet of the first card discharging passage, a card feeding passage, a delivery passage, and the first card discharging passage are connected in sequence and a playing card is sent out from the first card discharging passage. When the card turning component opens the card turning passage and closes the outlet of the first card discharging passage, the card feeding passage, the delivery passage, the first card discharging passage, the card turning passage, and the second card discharging passage are connected in sequence. The playing cards in the second card discharging passage are blocked by the card turning component after being sent out from the first card discharging passage, are turned to enter the card turning passage, and are sent to the end of the card turning passage by the card turning wheel and the card turning pressing wheel. The front ends of the playing cards abut against the card pushing component, and after the back ends of the playing cards pass through the card turning pressing wheel, the playing cards become flat again. Under the pushing force of the card pushing component, the back ends of the playing cards first enter the second card discharging passage and are sent out to the card receiving positions of the card receptor by the card turning pressing wheel and the second card discharge pressing wheel. In this way, the card turning passage is disposed to turn the playing cards required to be turned, and the unturned and turned playing cards are sent out from the two card outlet passages, so that continuous card turning and card distributing may be achieved, and card turning efficiency and card dealing efficiency are thereby significantly improved.

DESCRIPTION OF THE EMBODIMENTS

Figure 1:
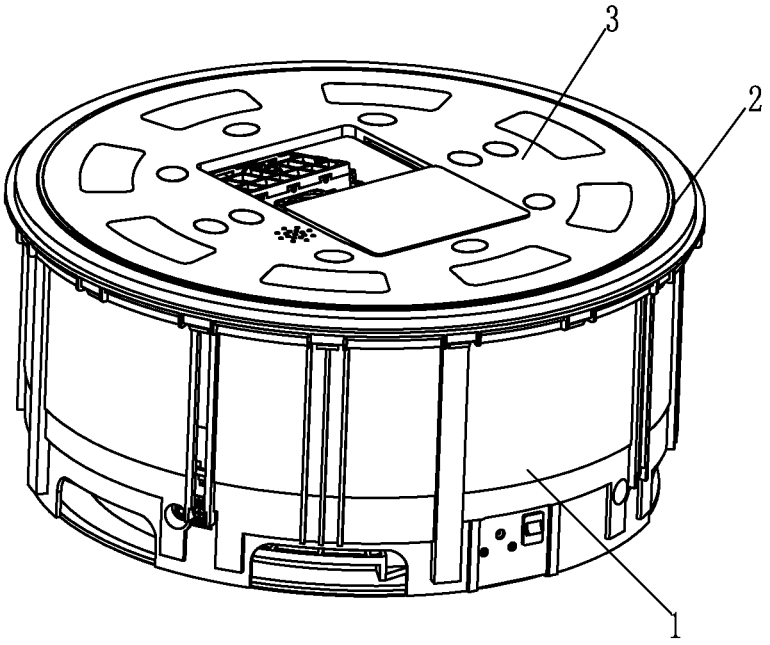
FIG. 1 is a perspective view of a poker machine (with a machine core not lifted) according to an embodiment of the disclosure.

The embodiments of the disclosure are provided in detail as follows. Examples of the embodiments are shown in the drawings, in which the same or similar reference numerals indicate the same or similar elements or elements with the same or similar functions throughout. The embodiments described below with reference to the accompanying drawings are exemplary, and are intended to explain the disclosure, but should not be construed as limiting the disclosure.

In the description of the disclosure, it should be understood that the terms "center", "perpendicular", "transverse", "length", "width", "thickness", "up", "down", "front", "rear", "left", "right", "vertical", "horizontal", "top", "bottom", "inner", "clockwise", "counterclockwise", and other indication orientations or positional relationships are based on the orientations and positional relationships shown in the drawings, are provided to facilitate the description of the disclosure and simplify the description, and are not intended to indicate or imply that the indicated device or element must have a specific orientation or be constructed and operated in a specific orientation, so cannot be understood as limiting the disclosure.

Further, the terms "first" and "second" are only used for descriptive purposes and cannot be understood as indicating or implying relative importance or implicitly indicating the number of indicated technical features. Thus, the features defined with "first" and "second" may explicitly or implicitly include one or more of these features. In the description of the disclosure, unless otherwise specified, "plurality" means two or more than two, unless specifically defined otherwise.

In the disclosure, unless clearly specified and defined otherwise, the terms "installed", "connected", "connecting", "fixed" and other terms should be understood in a broad sense, for instance, it can be a fixed connection, a detachable connection, or an integral connection, it can be a mechanical connection or an electrical connection, it can be a direct connection or indirect connection through an intermediate medium, and it can be the internal communication between two elements. For a person having ordinary skill in the art, the specific meaning of the above-mentioned terms in the disclosure can be understood according to specific circumstances.

In the disclosure, unless otherwise clearly specified and defined, the first feature being "above" or "below" the second feature may include direct contact between the first and second features or may include the first and second features not being in direct contact but being in contact through other features between them. Further, the first feature being "on", "above", and "upon" the second feature include that the first feature is directly above and obliquely above the second feature, or it may simply mean that the first feature is higher in level than the second feature. The first feature being "under", "below", and "beneath" the second feature include that the first feature is directly below and obliquely below the second feature, or it may simply mean that the first feature is lower in level than the second feature.

A poker machine as shown in FIG. 1 to FIG. 4 includes a base 1 and a machine core. The machine core is installed on the base or inside the base, and the movement includes a card receptor 2 and a card dealer. The movement is driven up and down on the base 1 through a lifting drive mechanism, and the card dealer is installed in a center of the card receptor 2 and is driven to rotate relative to the card receptor 2 by a rotating drive mechanism. The card dealer includes a card storage box 41 and a card dealing device 42. A plurality of card receiving positions are arranged on the card receptor 2 around the card dealer. A top portion of the card receptor 2 is provided with a panel 3, the panel 3 is provided with a card releasing hole, a door plate 301 and a driving mechanism thereof are installed on the card releasing hole, and the card storage box 41 is disposed under the card releasing hole.

Figure 2:
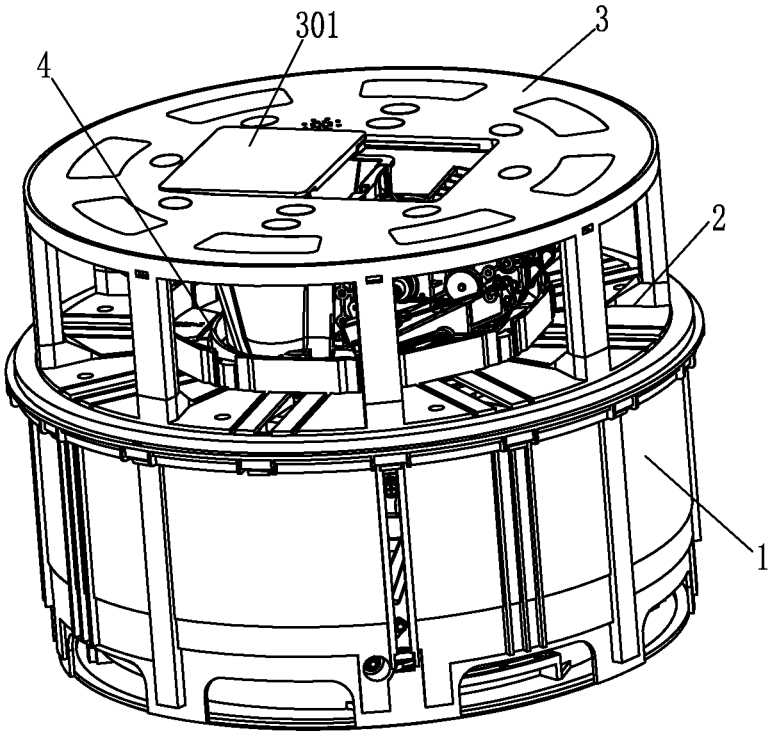
FIG. 2 is a perspective view of the poker machine (with the machine core lifted) according to an embodiment of the disclosure.
Figure 3:
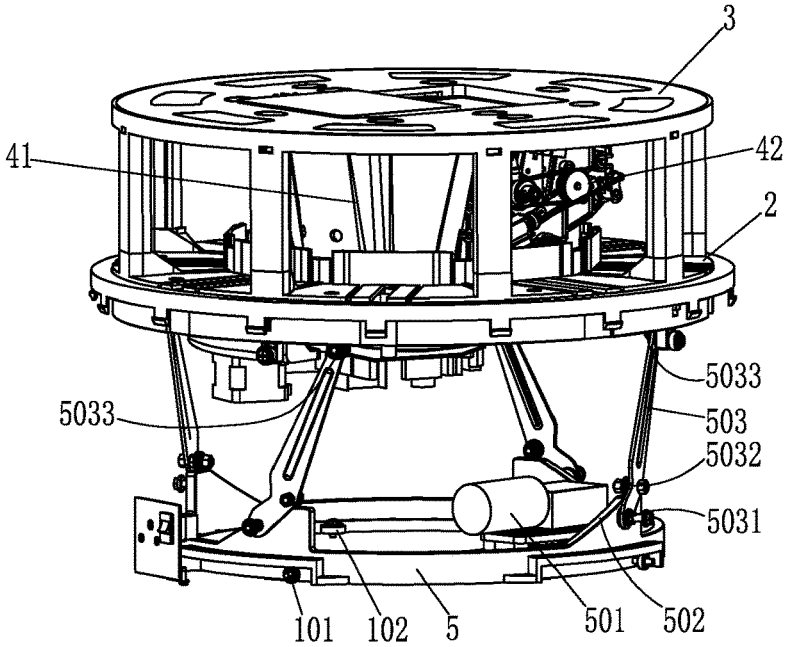
FIG. 3 is a perspective view of the poker machine (with the machine core lifted and a base omitted) according to an embodiment of the disclosure.
Figure 4:
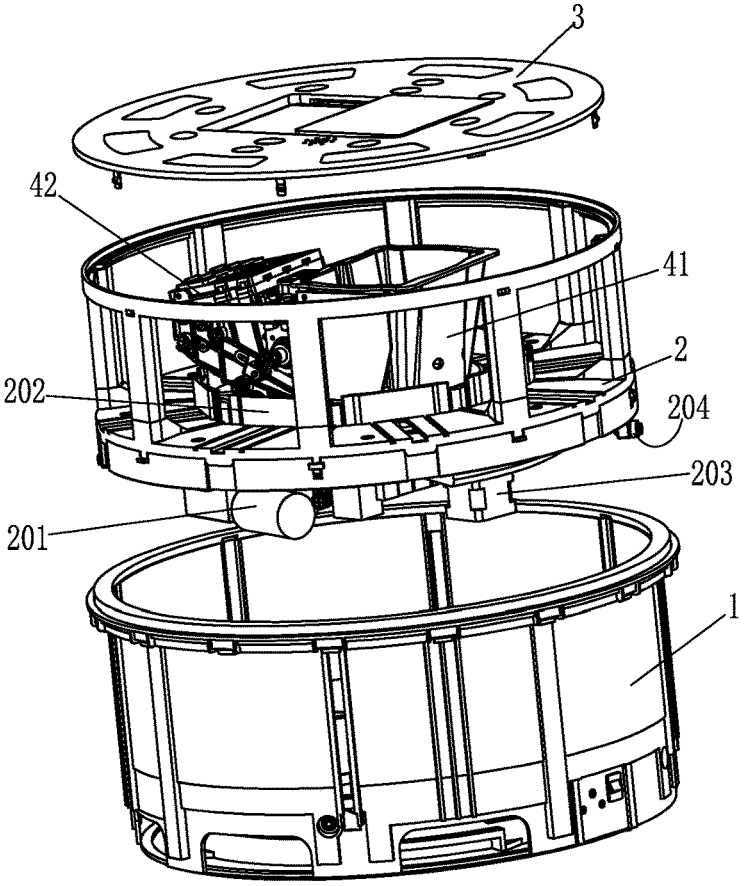
FIG. 4 is an exploded view of the poker machine according to an embodiment of the disclosure.

As shown in FIG. 2 and FIG. 3, in this embodiment, the base 1 includes a circular bottom plate and a barrel-shaped side wall. A power supply and a power switch thereof are installed on the base. The lifting drive mechanism configured for driving the machine core up and down is installed on the base. The distributed playing cards are placed on the card receptor 2 of the machine core.

This poker machine may be placed on a table as an independent machine for players to use, and in this scenario, the poker machine may not have the lifting drive mechanism (the base and the card receptor are integrated), but a plurality of openings are opened on the side wall of the base for the players to take the playing cards. In most cases, the poker machine is embedded in a center hole of a game table, and only the panel 3 is exposed and is flush with a table surface. In this way, the players may not be affected when playing cards, and manufacturing, installing, and maintaining may also be conveniently performed. In this scenario, a lifting drive mechanism needs to be provided on the base to drive the distributed playing cards of all parties to be lifted, so that the players can take the playing cards. It should be noted that each of the base and the card receptor provided by the disclosure is not limited to a cylindrical shape, but may also be in the shape of a square column, a polygonal column, a quincunx column, a truncated cone, and other various shapes.

In this embodiment, buttons are provided on the panel 3, and the buttons are used to control power-on, card shuffling, card dealing, and up-down movement of the machine core. When playing cards, players may set playing rules on the control panel. The poker machine deals cards to each player according to the set playing rules. When the cards are dealt, the playing cards of each player are randomly distributed by the rotating drive mechanism to drive the card dealer to rotate and randomly deal, and the cards are intermittently dealt to the card receiving position of each party on the card receptor according to the number of cards set by the players. The door plate 3 and a driving mechanism thereof are installed on the panel 3. Structures of the door plate 301 and the driving mechanism thereof may be found with reference to the disclosed patent publication of CN103157272 and CN108525278.

As shown in FIG. 3 to FIG. 8, in this embodiment, the card receptor 2 and the base 1 are not fixed and may be lifted up and down. The card receptor and the base may be matched with a plurality of guide posts and guide sleeves arranged around or with sliding grooves and sliding blocks acting as a lifting guide, and a plurality of guide rollers 204 are provided around the card receptor 2 to be matched with guide grooves on the side wall of the base 1 to realize the lifting and guiding of the card receptor 2. The panel 3 is fixed on the top portion of the card receptor 2, and a plurality of openings are formed on a peripheral side wall of the card receptor 2. When the card receptor 2 is lowered to the bottom, the panel 3 matches the table surface of the poker table, and when the card receptor 2 is completely raised, the bottom walls of the openings on the peripheral side wall of the card receptor 2 match the table surface of the poker table. The card dealer is installed in the center of the card receptor, and the card receiving positions are arranged on the card receptor 2 around the card dealer. The card receiving positions correspond to the openings. Each card receiving position is provided with a card pushing plate 202 and a card pushing slot 21, the card pushing plate 202 is driven to move back and forth from an inner side to an outer side of the card receiving position by a card pushing drive mechanism. When the card dealer deals cards, the card pushing plate 202 moves to the card receiving position close to the inner side of the card dealer, and a playing card is sent to the card receiving position. When the machine core is lifted to the table surface, the card pushing plate 202 moves from the inside to the outside along the card pushing slot 21 to push the playing card at the card receiving position out of the machine core onto the table surface. The card pushing slot 21 extends from the inside to the outside of the card receiving position, and the card pushing slot 21 is preferably disposed radially along a circumference of the card receiving position.

Figure 20:
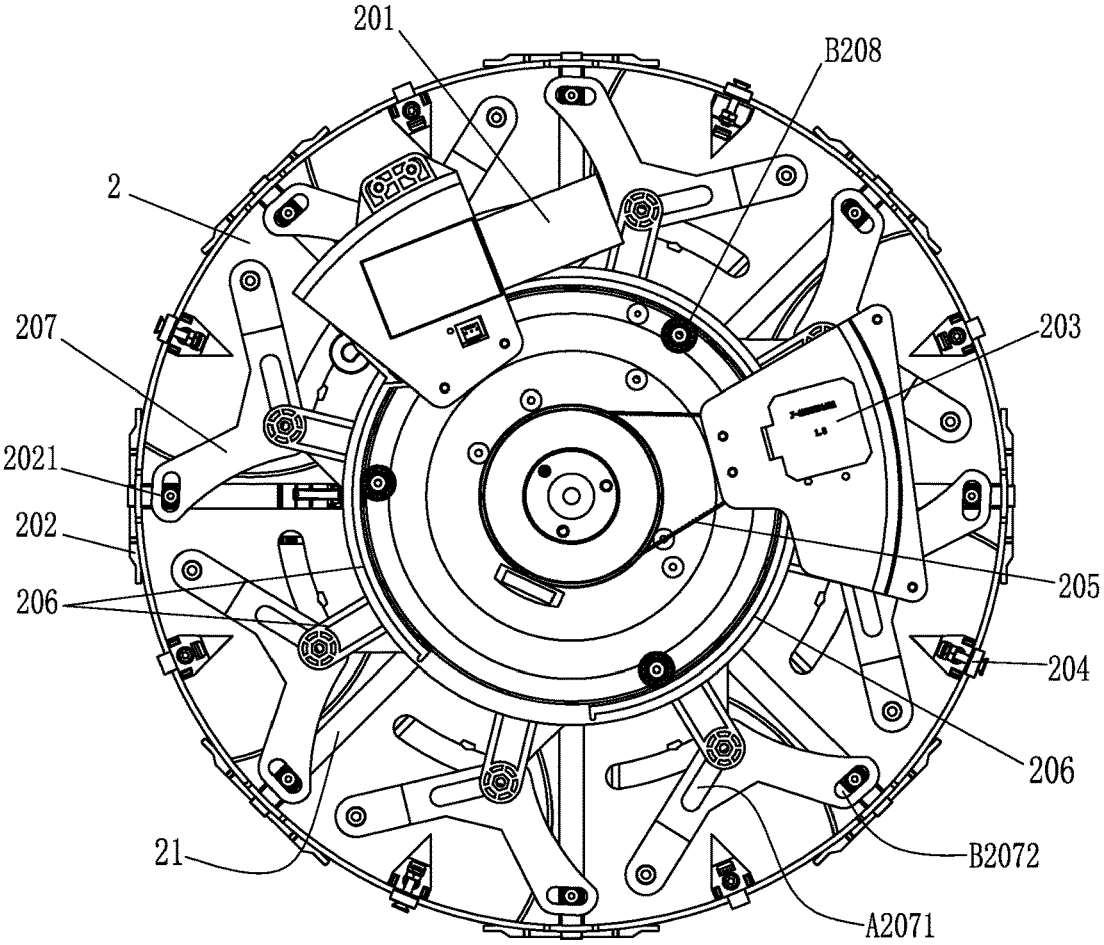
FIG. 20 is a bottom view of a bottom portion of a card receptor (with the card pushing plate being pushed out) according to an embodiment of the disclosure.
Figure 21:
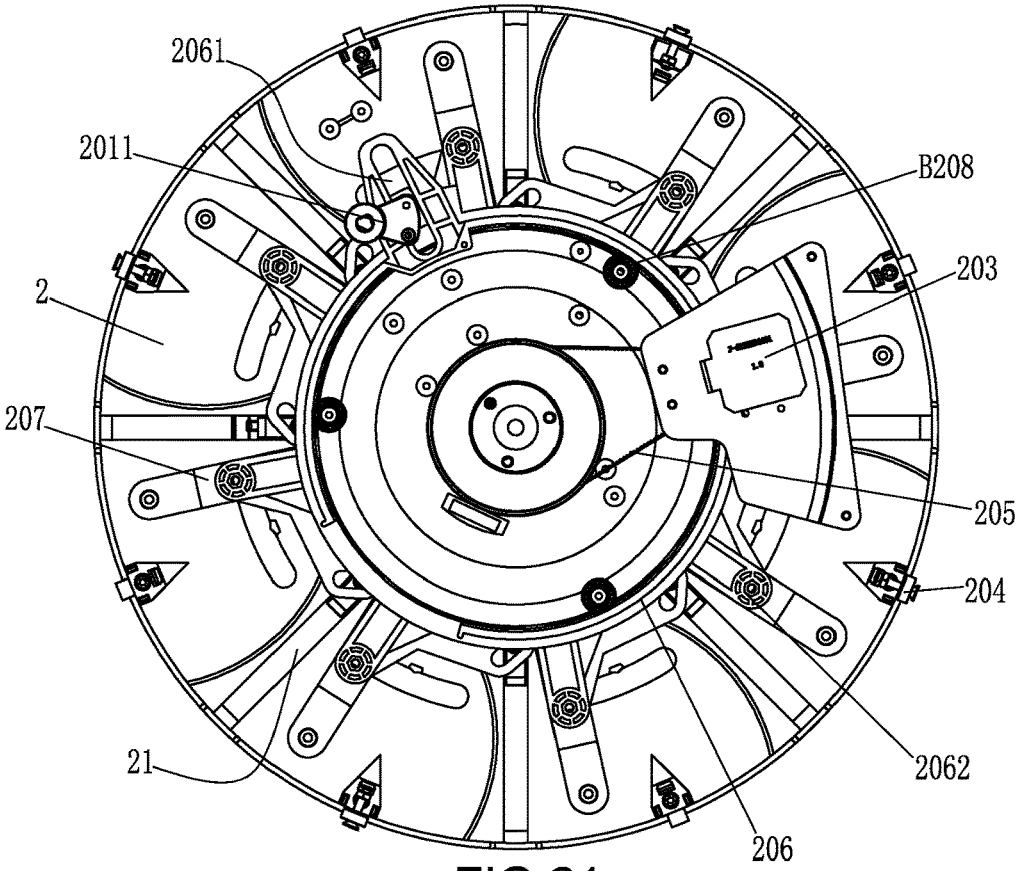
FIG. 21 is a bottom view of the bottom portion of the card receptor (with the card pushing plate not being pushed out) according to an embodiment of the disclosure.

As shown in FIG. 20 and FIG. 21, the card pushing drive mechanism is disposed under the card receptor 2 and includes a card pushing motor 201, a card pushing drive member 206, and a plurality of card pushing swing arms 207 corresponding to the card pushing plates 202 one-to-one. The card pushing drive member 206 has a circular ring shape, and the card pushing drive member 206 is installed at a bottom portion of the card receptor 2 through a plurality of positioning rollers B208 and is driven to rotate by the card pushing motor 201. A plurality of driving portions corresponding to the card pushing swing arms 207 protrude from an outer circumference of the card pushing drive member 206 one-to-one, and one driving portion is movably connected to a middle portion of one card pushing swing arm 207 through a sliding groove A2071. One end of the card pushing swing arm 207 is movably connected (hingedly connected) to the bottom portion of the card receptor 2, and the other end of the card pushing swing arm 207 is movably connected to a bottom portion of the card pushing plate 202 through a sliding groove B2072 and a card pushing roller 2021. In this way, by rotating the card pushing drive member 206, each card pushing swing arm 207 is pushed to rotate, and the card pushing plate 202 is thereby driven to push the card from the inside to the outside of the card receiving position or to move back and forth from the outside to the inside of the card receiving position. Such a card pushing drive member may synchronously drive the plural card pushing plates, as such, a simple structure, reasonable movements, and reliable operations are provided, and low manufacturing costs are required. The card pushing swing arm 207 is shaped as a V-shaped boomerang. The card pushing motor 201 drives the card pushing drive member 206 to rotate through a matching structure of a gear and a gear ring, or alternatively, the card pushing motor 201 drives the card pushing drive member 206 to rotate through a matching structure of a card pushing cam 2011 and a sliding groove 2061.

Figure 6:
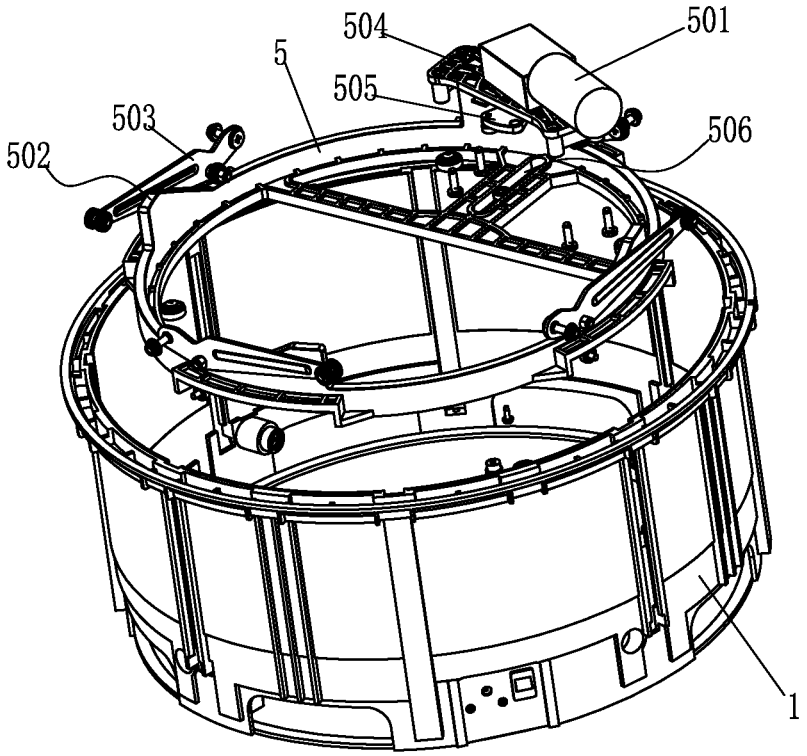
FIG. 6 is an exploded view of the base and a machine core lifting mechanism according to an embodiment of the disclosure.
Figure 7:
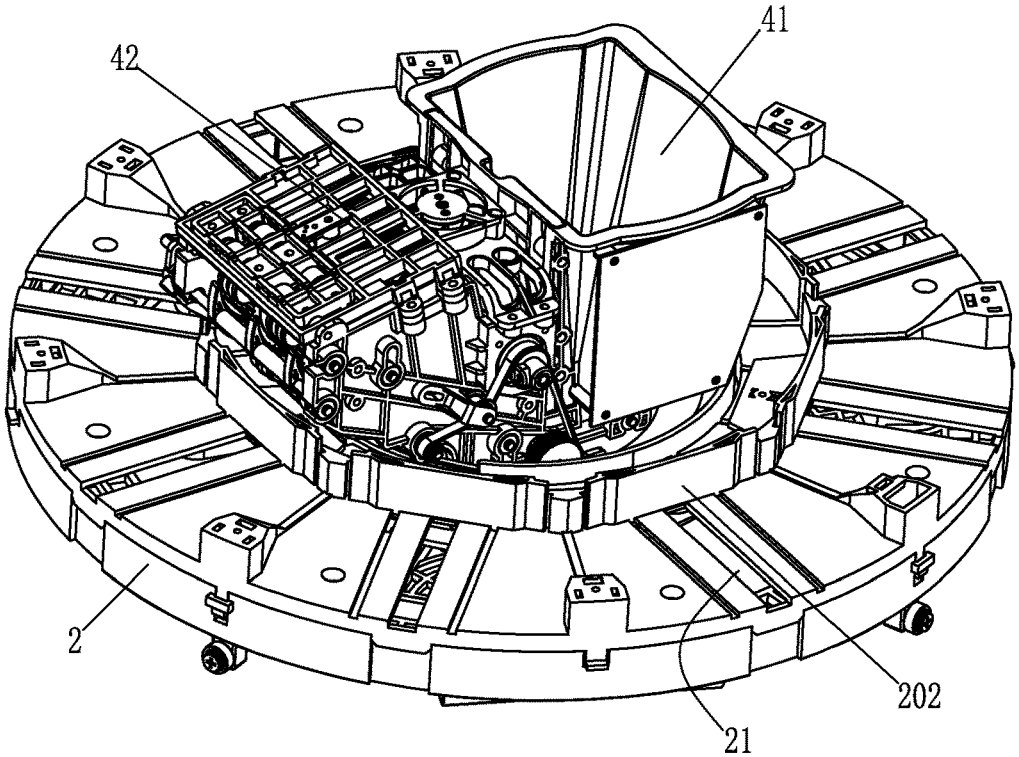
FIG. 7 is a perspective view of the machine core of the poker machine (with a card pushing plate not being pushed out) according to an embodiment of the disclosure.
Figure 8:
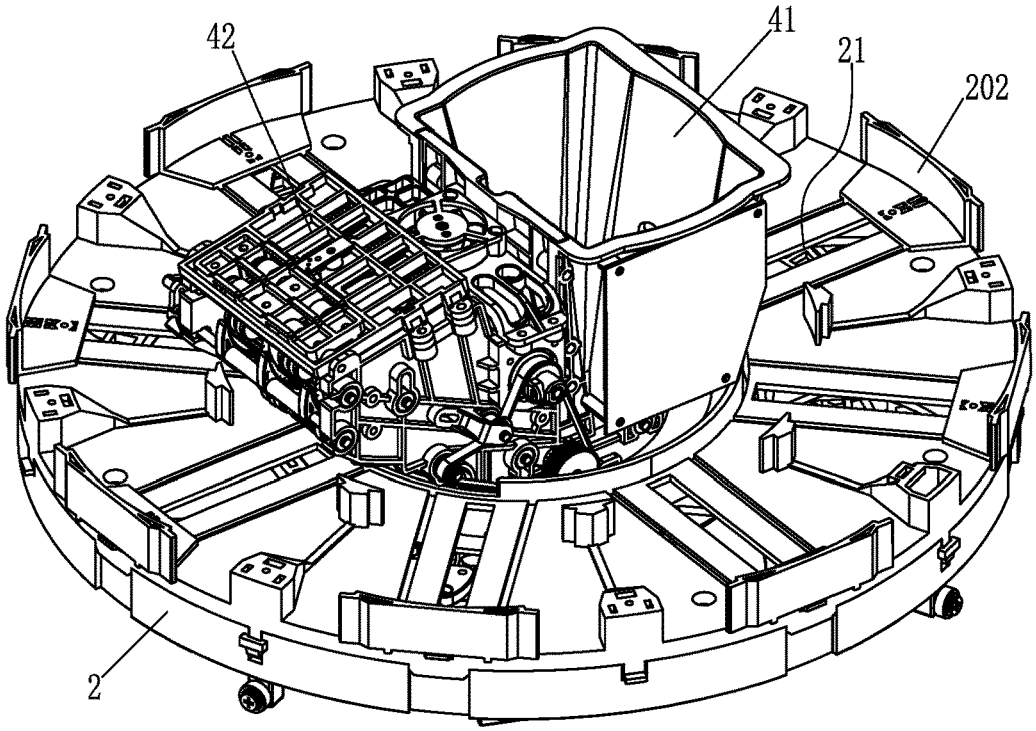
FIG. 8 is a perspective view of the machine core of the poker machine (with the card pushing plate being pushed out) according to an embodiment of the disclosure.
Figure 22:
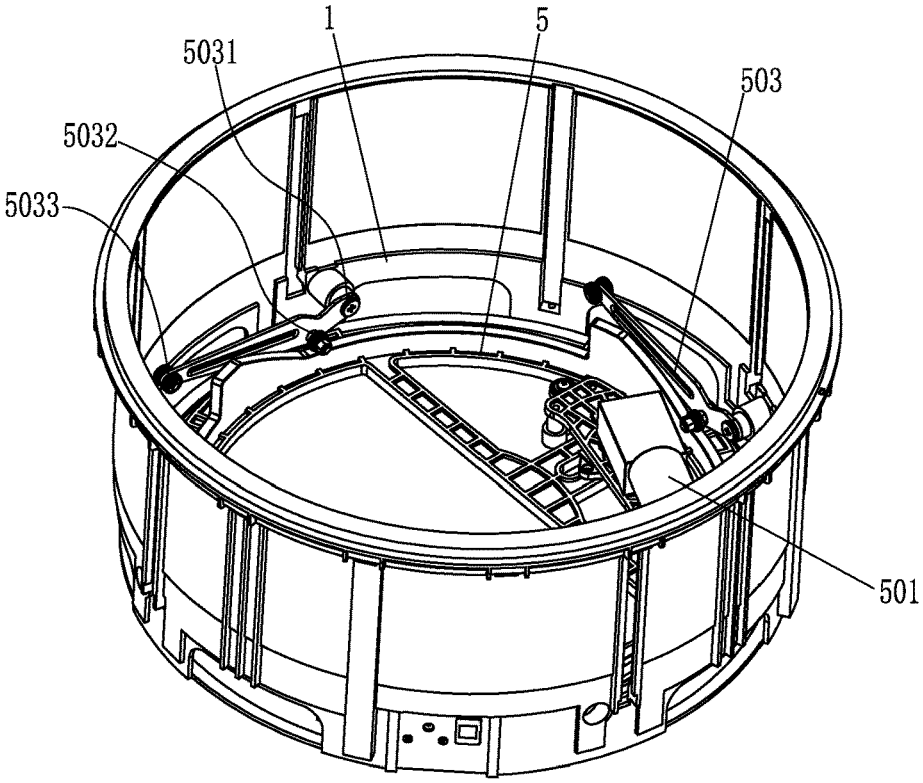
FIG. 22 is a structural schematic view of the base according to an embodiment of the disclosure.
Figure 23:
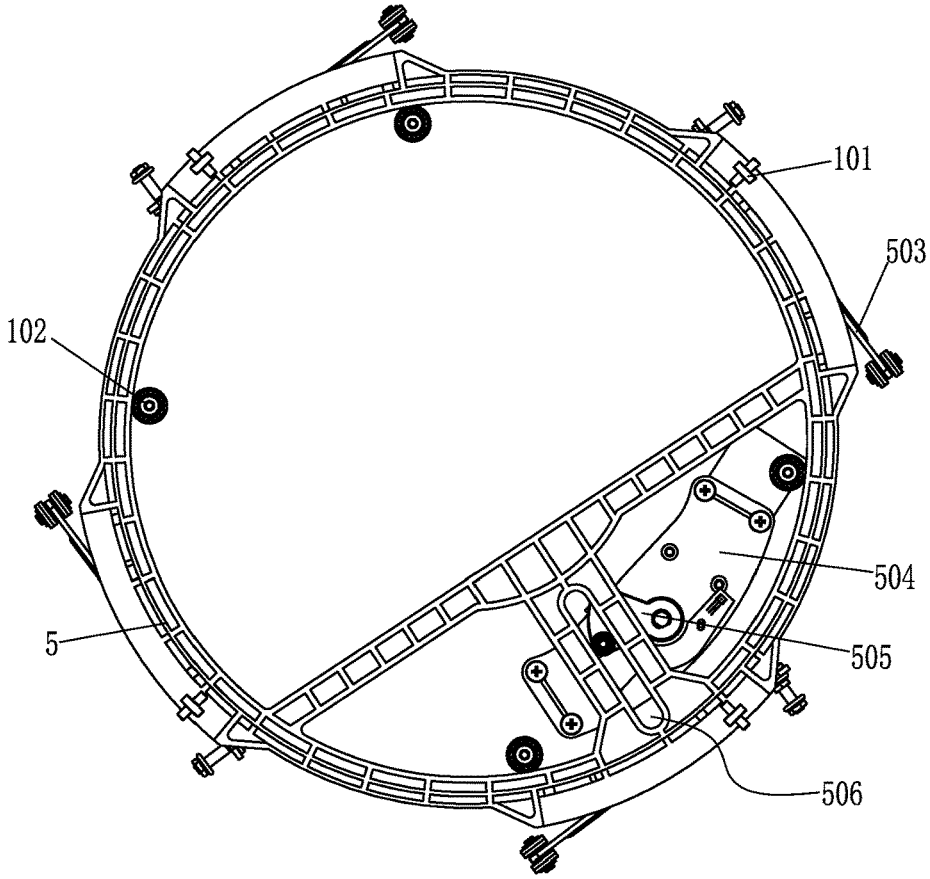
FIG. 23 is a structural schematic view of the machine core lifting mechanism according to an embodiment of the disclosure.

As shown in FIG. 3 and FIG. 6, a machine core lifting drive mechanism includes a lifting drive member 5, a lifting motor 501, and a plurality of lifting swing arms 503. The lifting swing arms 503 are evenly distributed below the card receptor 2 of the machine core, one end 5031 of each of the lifting swing arms 503 is hingedly connected to the base 1, and the other end 5033 of each of the lifting swing arms 503 abuts against the bottom portion of the card receptor 2 of the machine core. Regarding the lifting swing arms 503, the lifting swing arms 503 are driven by the lifting motor 501 through the lifting drive member 5 to synchronously swing to push the machine core lift up and lower down. In this embodiment, the lifting drive member 5 has a circular ring shape, a plurality of lifting protrusions 502 corresponding to the plurality of lifting swing arms 503 are disposed on a top portion of a periphery of the ring shape, and the lifting protrusions 502 abut against middle support rollers 5032 of the lifting swing arms 503. The lifting drive member 5 is installed on the base 1 through a support roller 101 and a positioning roller 102 and may rotate around a center of rotation. In this embodiment, a plurality of support rollers 101 are disposed on an outer side of a circular ring of the lifting driving member, and a matching groove is disposed on the lifting drive member to limit a rotation range of the lifting drive member 5. A plurality of positioning rollers 102 are installed on an inner side of the circular ring of the lifting drive member 5 to position the center of rotation of the lifting drive member. When the lifting drive member 5 is driven by the lifting motor 501 to rotate, the middle support rollers 5032 on the lifting swing arms 503 move along the corresponding lifting protrusions 502 on the lifting drive member 5. As such, the lifting protrusions 502 push the lifting swing arms 503 to swing, so that the ends 5033 of the lifting swing arms 503 abutting against a bottom portion of the machine core are lifted up and down, that is, the effect of lifting and lowering the machine core is implemented. As shown in FIG. 22 and FIG. 23, in this embodiment, the lifting motor 501 is installed on the base 1 through a lifting motor bracket 504. An output shaft of the lifting motor 501 (or an output shaft of a deceleration mechanism connected to the lifting motor) is equipped with a horizontally rotating lifting cam 505, and the lifting cam 505 is slidably matched with a lifting slide slot 506 on the lifting drive member 5 through a roller to drive the lifting drive member 5 to rotate. In other embodiments, the lifting motor may further drive the lifting drive member to rotate through internal or external meshing of a driving gear and a gear ring.

Figure 5:
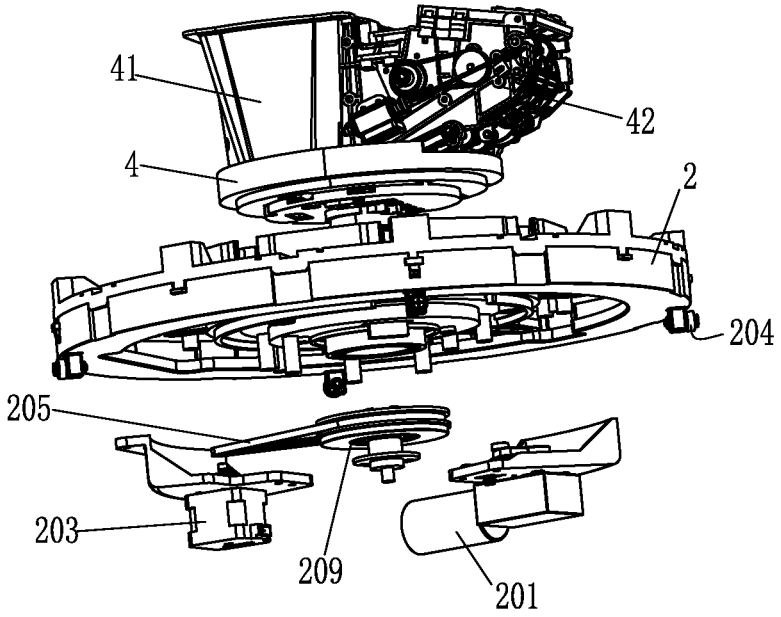
FIG. 5 is an exploded view of the machine core of the poker machine according to an embodiment of the disclosure.
Figure 9:
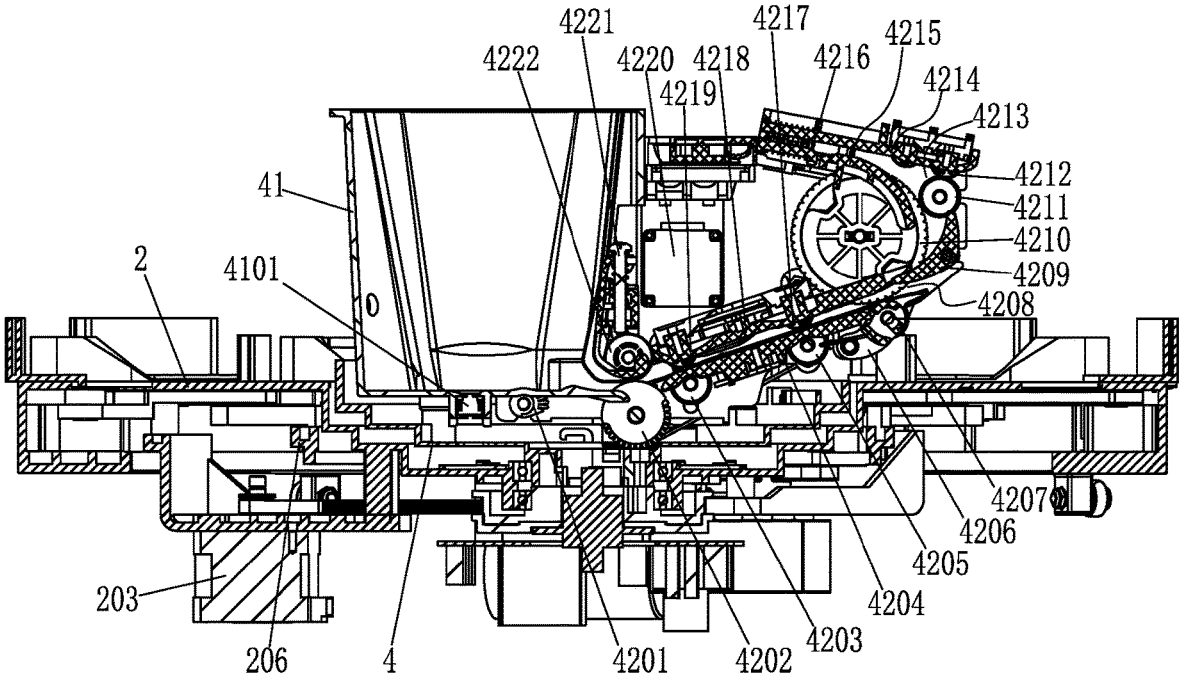
FIG. 9 is a cross-sectional view of the machine core of the poker machine according to an embodiment of the disclosure.
Figure 10:
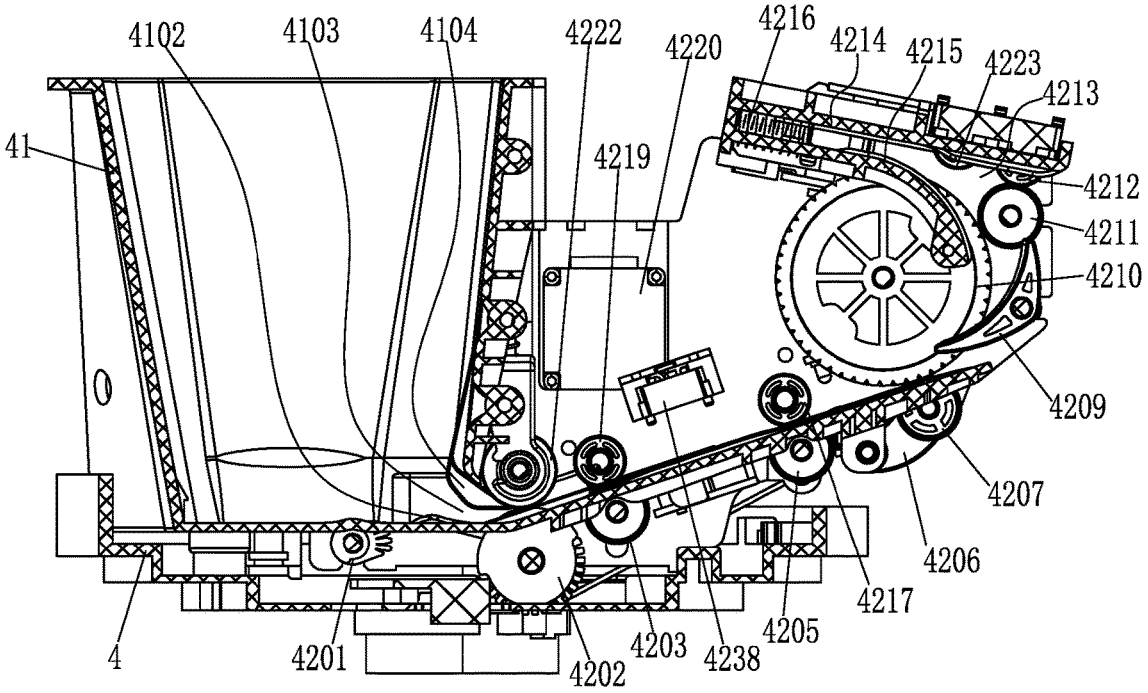
FIG. 10 is a first cross-sectional view of a card dealer (performing direct card distributing) according to an embodiment of the disclosure.

As shown in FIG. 4, FIG. 5, FIG. 7, and FIG. 8, the card dealer is fixed onto a dealer seat 4, and the dealer seat 4 is rotatably installed at a center position of an upper portion of the card receptor 2 through a bearing and is driven to rotate through the rotating drive mechanism. As shown in FIG. 5 and FIG. 9, the rotating drive mechanism includes a rotating motor 203 installed at the bottom portion of the card receptor 2 and a driven wheel 209 that is circumferentially fixed to and synchronously rotating with the dealer seat 4. The rotating motor 203 drives the driven wheel 209 through a rotating transmission belt 205 to drive the dealer seat 4 to rotate.

As shown in FIG. 9 to FIG. 15, the card dealer includes the card storage box 41 and the card dealing device 42. The card storage box 41 and the card dealing device 42 are respectively located on left and right sides of the dealer seat 4, and one side of a bottom portion of the card storage box 41 communicates with a card feeding passage of the card dealing device 42. In this embodiment, the card storage box is used to store a deck of playing cards that are sorted and stacked. The bottom portion of the card storage box 41 is equipped with a detection sensor 4101 for detecting whether there are any playing cards and a card sending wheel 4201 for pushing the playing cards to the card feeding passage of the card dealing device 42. A card blocking plate 4105 is formed on a side wall of the card storage box 41 close to the card feeding passage of the card dealing device 42. A plurality of card feeding ribs 4104 are disposed on the card blocking plate 4105, and a card separating wheel 4202 of the card dealing device 42 is disposed below the card inlet ribs 4104. A plurality of card feeding protrusions 4102 are formed on an inner wall of the bottom portion of the card storage box 41 between the card sending wheel 4201 and the card separating wheel 4202. In this way, a card feeding passage 4103 of the card dealing device 42 is formed between the card feeding protrusions 4102 and the card feeding ribs 4104. Such card feeding passage with protruding and recessed structures helps to separate the multiple overlapping playing cards through squeezing and rubbing. Preferably, the card feeding protrusions 4102 and the card feeding ribs 4104 are arranged in an alternating manner, and a favorable card squeezing and separating effect is thus provided.

The card dealing device 42 includes a poker card separating mechanism, a delivery mechanism, and a poker card turning mechanism. A passage for playing cards in the card dealing device 42 to pass includes a card feeding passage 4103, a delivery passage, a card turning passage 4224, a first card discharging passage 4208, and a second card discharging passage 4213. A card turning component 4209 for opening or closing the card turning passage 4224 or an outlet of the first card discharging passage 4208 is provided near the first card discharging passage 4208. When the card turning component 4209 closes the card turning passage 4224 or opens the outlet of the first card discharging passage 4208, the card feeding passage 4103, the delivery passage, and the first card discharging passage 4208 are connected in sequence. When the card turning component 4209 opens the card turning passage 4224 and closes the outlet of the first card discharging passage 4208, the card feeding passage 4103, the delivery passage, the first card discharging passage 4208, the card turning passage 4224, and the second card discharging passage 4213 are connected in sequence. The poker card separating mechanism is installed at the card feeding passage of the card dealing device 42, the delivery mechanism is installed on a position of the delivery passage, and the poker card turning mechanism is disposed between the first card discharging passage 4208 and the second card discharging passage 4213.

The poker card separating mechanism may adopt the various poker card distributing structures disclosed in t a series of patent publication of CN108525278A and CN105854274A, etc. Nevertheless, although these card separating structures may better separate the entering playing cards to ensure a single pass, it is difficult for the playing cards that have entered the delivery passage to be returned from the card feeding passage (card returning). As such, once a subsequent sensor detects that two playing cards overlap and it is necessary to return the playing cards from the card let passage and notify of card re-separation, the problem of difficulty in card returning may occur. In order to overcome this technical problem, in this embodiment, the poker card distributing mechanism preferably includes the following structure.

As shown in FIG. 9 to FIG. 12, the card blocking plate 4105, the card sending wheel 4201, the card separating wheel 4202, and a card separating pressing wheel 4222 are included. The card sending wheel 4201 for pushing the playing cards to the card feeding passage of the card dealing device 42 is installed on the bottom portion of the card storage box 41. A bottom of the card blocking plate 4105 is provided with the card separating pressing wheel 4222, and the card separating wheel 4202 is disposed under the card separating pressing wheel 4222. The card separating wheel 4202 is driven to rotate through a card dealing motor, and the card separating pressing wheel 4222 may not rotate when cards enter and may rotate when cards return through a one-way clutch mechanism. In this way, a fast and effective card separating effect may be achieved when cards enter. Further, when a card is required to be returned, the card separating pressing wheel 4222 may be reversely rotated together with the card separating wheel 4202 to achieve fast and reliable card returning and avoid the difficulty of card returning. Preferably, the card separating pressing wheel 4222 and the card separating wheel 4202 are arranged in an alternating manner of back and forth and are overlapped with each other up and down (i.e., an axis of the card separating pressing wheel 4222 and an axis of the card separating wheel 4202 are misaligned by a horizontal distance, the card separating pressing wheel 4222 is closer to a card storage space of the card storage box 41 than the axis of the card separating wheel 4202, and a lowest portion of the card separating pressing wheel 4222 is lower than a highest portion of the card separating wheel 4202). In this way, when multiple playing cards enter a gap between the card separating pressing wheel 4222 and the card separating wheel 4202, entry ends of the playing cards may be tilted up, causing the upper and lower playing cards to be misaligned, and electrostatic adhesion of the upper and lower playing cards which may lead to failure of separation of the two playing cards is thereby prevented from occurring. The card separating pressing wheel 4222 is controlled by the one-way clutch mechanism and cannot rotate, so that a static friction force between the card separating pressing wheel 4222 and the upper playing card is much greater than a friction force between the upper and lower playing cards. Further, the delivery power of the playing cards comes from the card separating wheel 4202, which is applied onto the playing cards below. Therefore, the lower playing card is delivered to continue to move forwards, and the upper playing card is temporarily stranded. The upper and lower playing cards are separated at a fast separation speed, and such a structure is simple, easy to maintain, and exhibits high accuracy.

In order to further enhance the effect of the above-mentioned poker card separating mechanism, the card feeding ribs 4104 are disposed on the bottom portion of the card blocking plate 4105. The card feeding protrusions 4102 are formed on the inner wall of the bottom portion of the card storage box 41 between the card sending wheel 4201 and the card separating wheel 4202. The card feeding ribs 4104 are closer to the card separating pressing wheel 4222 than the card feeding protrusions 4102, so that the card feeding passage 4103 of the card dealing device 42 is formed among the card feeding protrusions 4102, the card feeding ribs 4104, and the card separating wheel 4202. The card feeding passage 4103 has protruding structures at two ends (the card feeding protrusions 4102 and the card separating wheel 4202) and a recessed structure at the middle part. In this way, such card feeding passage with protruding and recessed structures may facilitate squeezing and separating of multiple overlapping playing cards, so that the multiple playing cards entering the positions of the card separating wheel 4202 and the card separating pressing wheel 4222 are separated back and forth. In addition, the card feeding protrusions 4102 may lift the playing cards in the card storage box 41 out of the card feeding passage 4103, so when cards are returned, the playing cards returned from the card feeding passage are inserted under the playing cards in the card storage box 41 to avoid the difficulty of card pushing due to the abutting of two playing cards. Preferably, the card feeding protrusions 4102 and the card feeding ribs 4104 are arranged in an alternating manner, and a favorable card squeezing and separating effect is thus provided.

Figure 16:
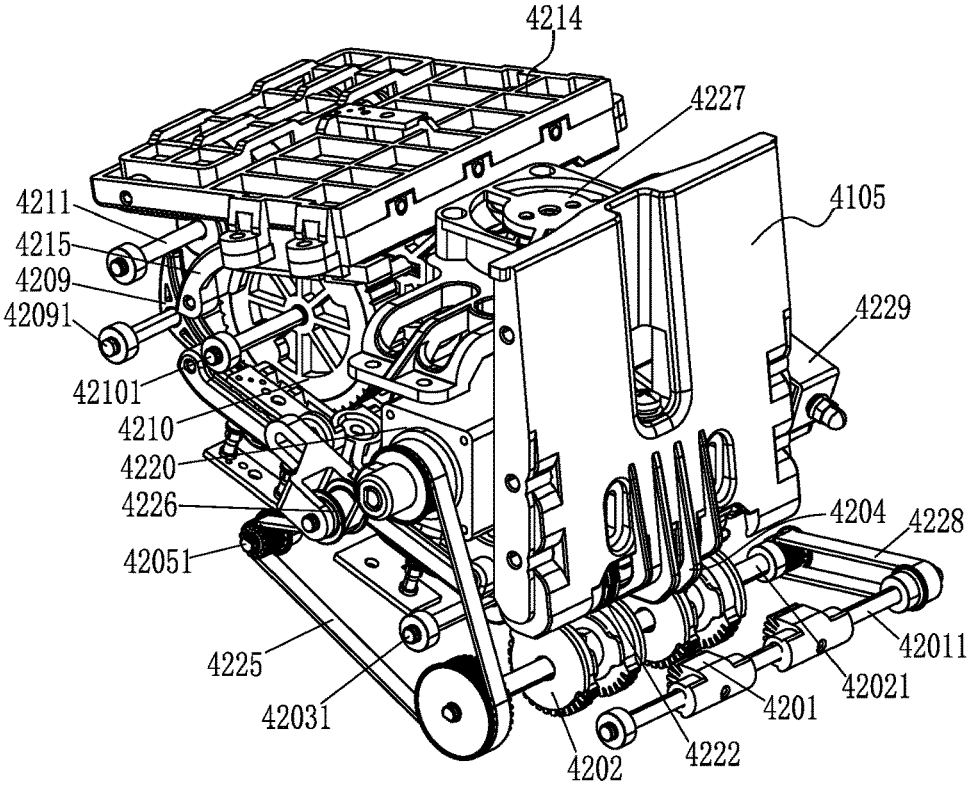
FIG. 16 is a first perspective view of a card dealing device (with partial housing omitted) according to an embodiment of the disclosure.
Figure 17:
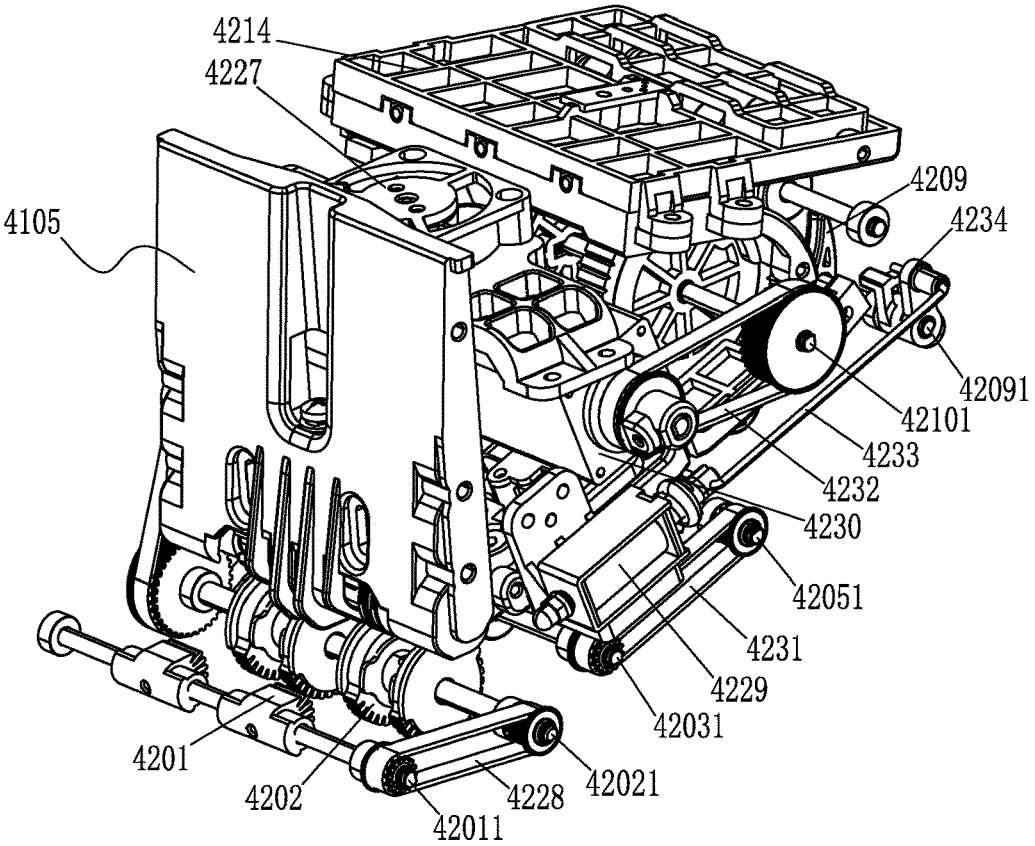
FIG. 17 is a second perspective view of the card dealing device (with partial housing omitted) according to an embodiment of the disclosure.
Figure 18:
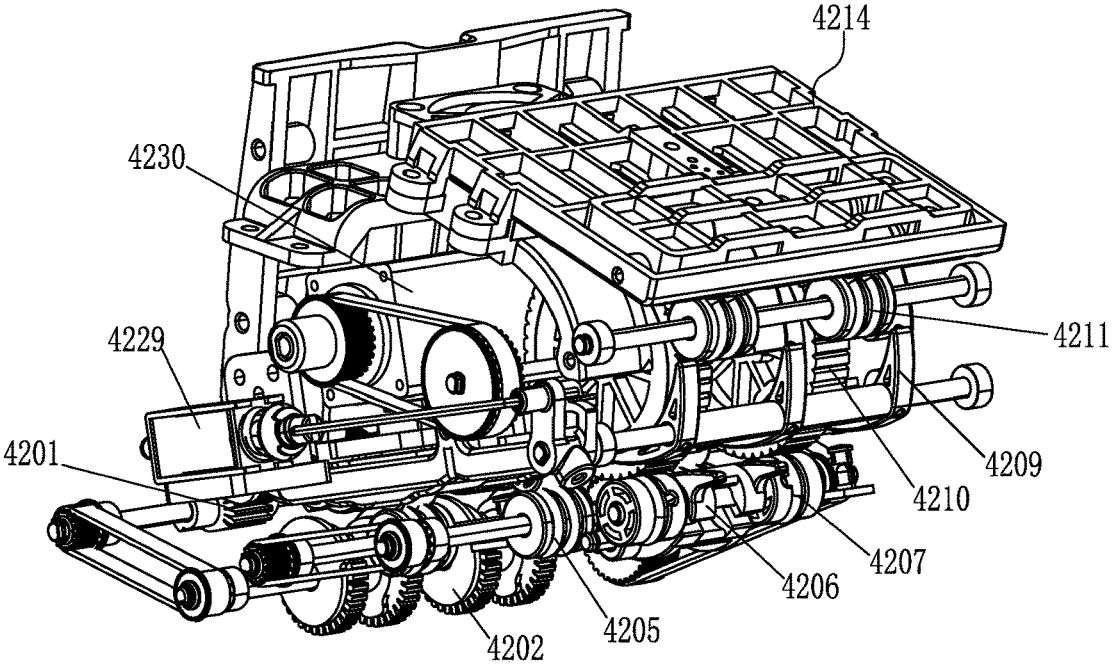
FIG. 18 is a third perspective view of the card dealing device (with partial housing omitted) according to an embodiment of the disclosure.

In this embodiment, one side of the card sending wheel 4201 is protrudingly formed with arc-shaped teeth, so that the playing cards may be pushed upwards and forwards during the rotation of the card sending wheel 4201, and the playing cards may better cross over the card feeding protrusions 4102. In addition, this movement may also prevent the front and back playing cards from abutting against each other and being stuck when the card dealing device returns the cards. The card separating pressing wheel 4222 is passively rotated in one way. In order to facilitate adjustment, the card separating pressing wheel 4222 is installed on the bottom portion of the card blocking plate 4105 through an elastic pressing mechanism. The elastic pressing mechanism is a compression spring and a top rod 4221, and the one-way clutch mechanism is a one-way clutch installed on a shaft of the card separating pressing wheel 4222. Each of the card separating wheel, the card sending wheel, and the card separating pressing wheel may be a roller part or may be formed by a plurality of wheel-shaped parts installed on a same shaft. For instance, as shown in FIG. 16 and FIG. 17, each card separating wheel 4202 includes a support frame with certain rigidity and a rubber ring sleeved on and fixed to the support frame. Part of an arc-shaped circumference of the rubber ring is protruding arc-shaped rubber teeth for contacting the playing cards, and a circumference of a portion of the rubber ring except the arc-shaped rubber teeth is lower than a circumference of a side wall of the support frame. In this way, when the arc-shaped rubber tooth portion of the card separating wheel contacts the playing cards, a considerable friction force is provided, such that it is easy to drive the playing cards to move. When the circumference of the side wall of the support frame of the card separating wheel contacts the playing cards, a small friction force is provided, such that it is difficult to drive the playing cards to move. Such a gap-type manner for driving the playing cards to move may facilitate separating of two playing cards. Four card separating wheels 4202 are installed on a same card separating wheel shaft 42021. The card feeding rib 4104 and the card separating pressing wheel 4222 at the bottom of the card blocking plate 4105 and the four card separating wheels 4202 are disposed in an alternating manner of up and down, so as to facilitate the adjustment of upper and lower gaps to realize fast and effective card separating. A card sending wheel shaft 42011 of the card sending wheel 4201 and the card separating wheel shaft 42021 of the card separating wheel 4202 are connected through a card feeding transmission belt 4228. In this way, the matched rotation of the card sending wheel 4201 and the card separating wheel 4202 is realized, and the card separating efficiency and the card separating effect are improved.

As shown in FIG. 9 to FIG. 12, the delivery mechanism includes a first delivery wheel 4203 and a second delivery wheel 4205 installed on a delivery bottom portion wall 4204 of the delivery passage and a first delivery pressing wheel 4219 and a second delivery pressing wheel 4217 installed on a delivery top portion wall 4218 of the delivery passage. The first delivery pressing wheel 4219 and the first delivery wheel 4203 are matched up and down, and the second delivery pressing wheel 4217 and the second delivery wheel 4205 are matched up and down. The first delivery pressing wheel 4219 and the second delivery pressing wheel 4217 are driven wheels, and the first delivery wheel 4203 and the second delivery wheel 4205 are driven wheels and are provided with rubber rings to increase friction. A first delivery wheel shaft 42031 of the first delivery wheel 4203, a second delivery wheel shaft 42051 of the second delivery wheel 4205, the card separating wheel shaft 42021 of the card separating wheel 4202, and a card dealing motor shaft 42201 of the card dealing motor 4220 are drivingly connected by a card dealing transmission belt 4225. The card dealing transmission belt 4225 is tensioned by a tensioning wheel 4226, and in this way, the synchronous movement of card entering, card separating, and card delivery is achieved. Each of the first delivery wheel 4203, the second delivery wheel 4205, the first delivery pressing wheel 4219, and the second delivery pressing wheel 4217 may be directly pressed and matched with each other up and down and may also be aligned in an alternating manner up and down. Each of these components may be a roller part or may be formed by a plurality of wheel-shaped parts installed on the same shaft.

Figure 13:
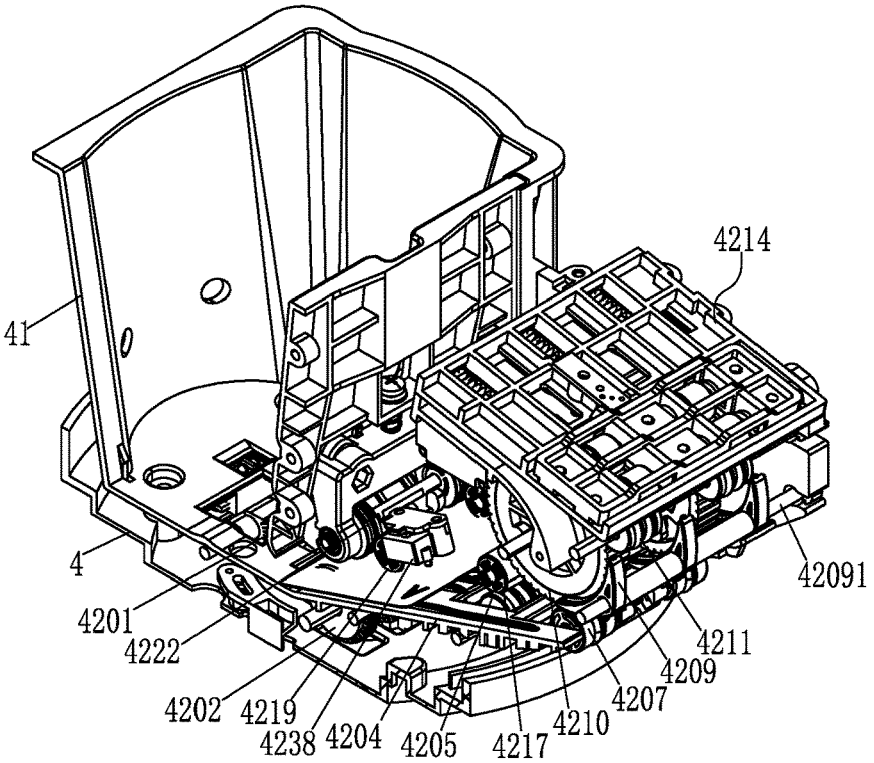
FIG. 13 is a local cross-sectional perspective view of the card dealer according to an embodiment of the disclosure.
Figure 14:
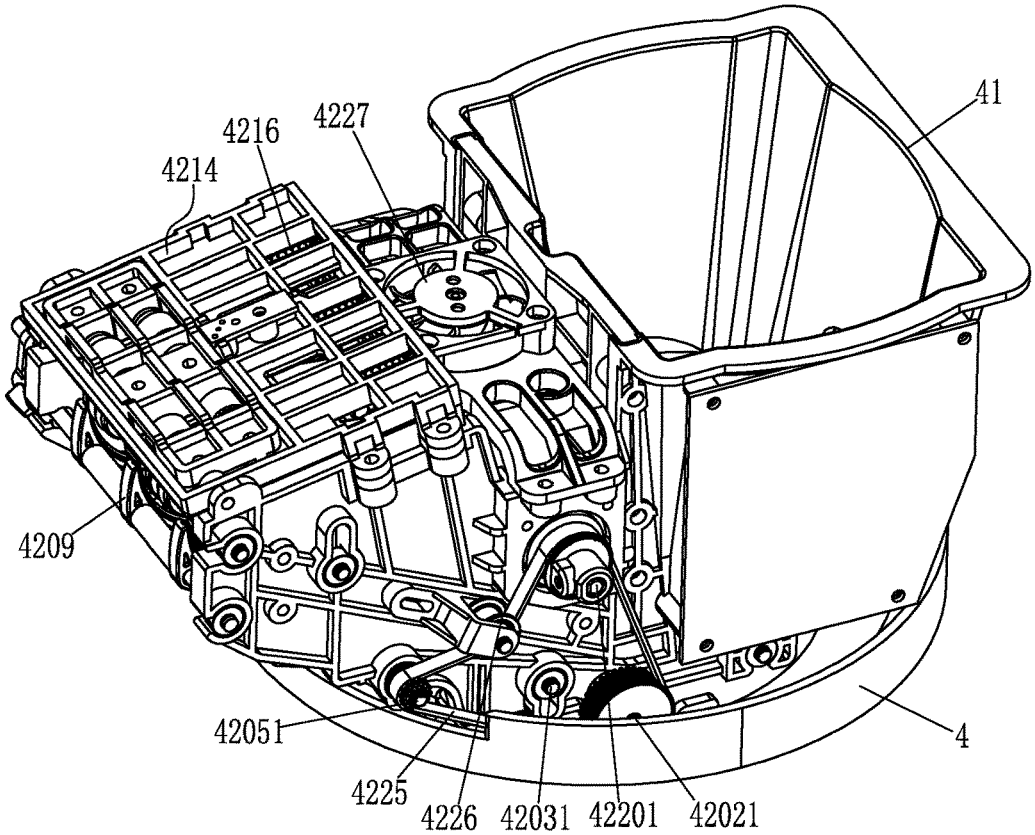
FIG. 14 is a first perspective view of the card dealer according to an embodiment of the disclosure.
Figure 19:
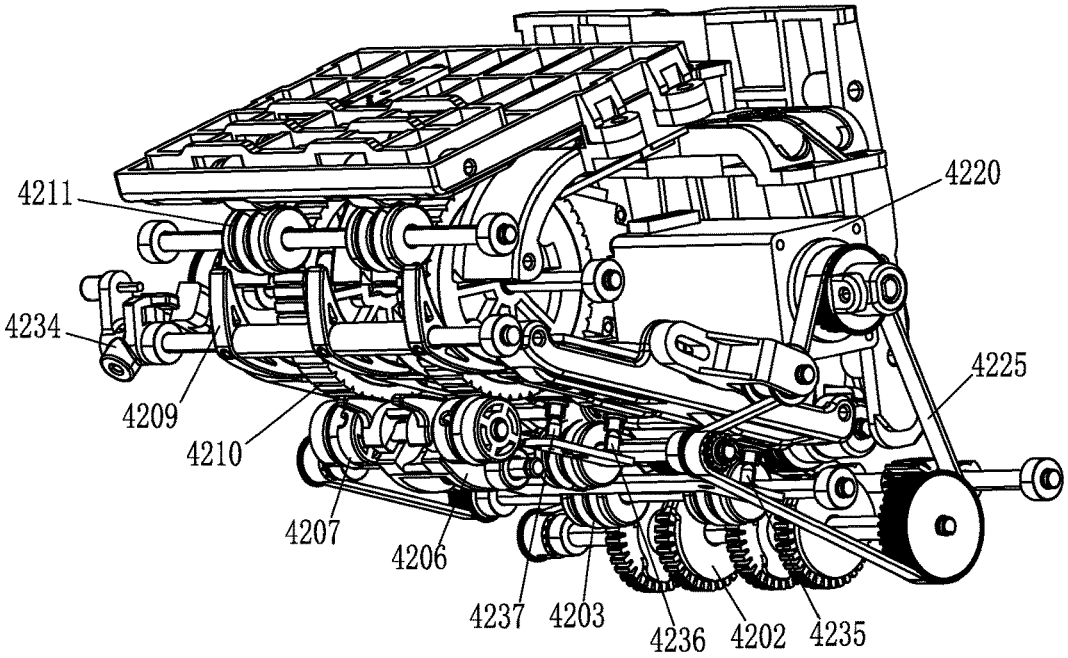
FIG. 19 is a fourth perspective view of the card dealing device (with partial housing omitted) according to an embodiment of the disclosure.

As shown in FIG. 13 and FIG. 19, an identification element for identifying the front and back of a playing card and a plurality of detection elements for detecting the playing cards are provided in the delivery passage of the card dealer.

Regarding the identification of the front and back of a playing card in the delivery passage, one method is to obtain photo information of different positions on the same side of the playing card. The pattern on the back of the playing card is used as the regularity of high incidence of the four consecutive positions of the unit pattern, and it is determined whether it is the front or the back of the playing card according to the degree of incidence of the patterns of these photos. Another method is that, according to the characteristic that the fixed positions on the diagonal corners of the front of a playing card must be provided with characters, the front and back sides of the playing card may be identified by distinguishing the character patterns on the fixed positions of the diagonal corners of the playing card, such as the master's thesis titled provided by Kou Yongjun, "The Application Research of Image Recognition on Card Dealer", published in the Journal of Hunan University in 2007. Another method is to print magnetic ink at a fixed position on the front or back of a playing card, and the front and back of the playing card is then identified by detecting the magnetic ink. For the first two identification methods, the identification element is a camera. For the third identification method, the identification element is a magnetic detection sensor.

Regarding identifying whether the playing cards in the delivery passage overlap each other, one method is to detect a length of each of the playing cards. When the detection element detects that the length of the playing cards in the delivery passage is longer than a normal length, it may be determined that there are multiple overlapping playing cards. Another method is to detect a thickness of each of the playing cards. When the detection element detects that the thickness of the playing cards in the card feeding passage, the delivery passage, or the first card discharging passage is greater than a normal thickness, it may be determined that there are multiple overlapping playing cards. One or more methods may be used in the same card dealing device.

When it is identified that the playing cards in the delivery passage do not need to be turned over, the poker card turning mechanism sends out the playing cards directly, and when it is identified that the playing cards in the delivery passage need to be turned over, the poker card turning mechanism turns and then sends out the playing cards. When it is identified that the playing cards need to be returned from the card dealing device, the card dealing motor 4220 drives the first delivery wheel 4203, the second delivery wheel 4205, the card separating wheel 4202, and the card sending wheel

4201 to reverse and implement card returning. One or more methods may be used in the same card dealing device.

In the disclosure, the front and back of the playing cards are identified in the delivery passage, and the playing cards are turned in the card turning passage. The two steps do not affect each other, continuous card turning and dealing can be achieved, and the card turning efficiency and the dealing efficiency are greatly improved.

As shown in FIG. 13, in this embodiment, the identification element used to identify the front and back of a playing card is a camera 4238, and the camera 4238 and a detection sensor for detecting the presence of the playing cards are fixed onto the delivery bottom portion wall 4204 or the delivery top portion wall 4218 of the delivery passage. When the detection sensor detects a playing card, the camera is activated at the same time or is delayed to be activated, so that the camera may just capture the pattern information on the diagonally fixed position of the playing card in the delivery passage. In this way, a controller may identify the front and back of the playing card based on the pattern information, for example, it is determined as the front when it is recognized as a character pattern.

In order to ensure that the camera may be activated in time and take a panoramic view of the character patterns on the playing cards, the following settings are preferably provided.

In the first case, the playing cards are delivered forwards along a width side in the card dealing device (that is, the width of the delivery passage is close to the width of the playing cards). In this way, a preferred value range of a width B of the delivery passage is: playing card width+1 mm<B<playing card width+5 mm.

A value range of a vertical distance M between a lens center of the camera and a left side wall or a right side wall of an adjacent delivery passage is: a vertical distance between the character pattern of a playing card and its adjacent side edge<M<a vertical distance between the character pattern of the playing card and its adjacent side edge+5 mm.

A value range of a vertical distance H between the lens center of the camera and the playing cards in the delivery passage is: 10 mm<H<15 mm.

Taking a commonly used playing card (bridge size is 8.8 cm long and 5.7 cm wide) as an example, the value ranges are 58 mm<B<62 mm and 6 mm<M<12 mm.

In the second case, the playing cards are delivered forwards along a length side in the card dealing device (that is, the width of the delivery passage is close to the length of the playing cards). In this way, a preferred value range of the width B of the delivery passage is: playing card length+1 mm<B<playing card length+5 mm.

The value range of the vertical distance M between the lens center of the camera and the left side wall or the right side wall of the adjacent delivery passage is: the vertical distance between the character pattern of a playing card and its adjacent side edge<M<the vertical distance between the character pattern of the playing card and its adjacent side edge+5 mm.

The value range of the vertical distance H between the lens center of the camera and the playing cards in the delivery passage is: 10 mm<H<15 mm.

Taking a commonly used playing card (bridge size is 8.8 cm long and 5.7 cm wide) as an example, the values are 89 mm<B<93 mm and 6 mm<M<12 mm.

In other embodiments, through a specific delivery method, speed, and direction, the playing cards in the delivery passage may be delivered closer to the side of the left or right side. In this way, the width of the delivery passage may not affect the settings of the camera, and only the following is required to be defined. The value range of the vertical distance M between the lens center of the camera and the left side wall or the right side wall of the adjacent delivery passage is: the vertical distance between the character pattern of a playing card and its adjacent side edge<M<the vertical distance between the character pattern of the playing card and its adjacent side edge+5 mm. Taking a commonly used playing card (bridge size is 8.8 cm long and 5.7 cm wide) as an example, the value is 6 mm<M<12 mm. The value range of the vertical distance H between the lens center of the camera and the playing cards in the delivery passage is: 10 mm<H<15 mm.

In this way, unnecessary scratching and obstruction that may occur to the playing cards and the side walls of the delivery passage may be avoided, and further, it may also be ensured that the camera may still take a panoramic view of a position of a character of a playing card when the playing card is tilted in the delivery passage.

Besides, in order to avoid or lower influences brought by uncertain factors such as an advancing speed of the playing cards in the delivery passage, it is preferable to arrange the detection sensor for detecting the presence of the playing cards and the camera 4238 adjacent to each other. In this way, the camera may be activated immediately after the detection sensor detects that the playing card is in place to take a panoramic view of the position of the character of the playing card. In other embodiments, it may also be preferable to provide two cameras in the delivery passage. The two cameras are respectively close to the left side wall and right side wall of the delivery passage, and multiple cameras are used to photograph and identify to improve the accuracy and efficiency of the identification of the front and back of the playing cards.

Note that the aforementioned width of the delivery passage refers to an effective width of the delivery passage that may deliver playing cards. The left side wall or the right side wall of the delivery passage refers to the theoretical left side wall or the right side wall of the effective width. In an applicable embodiment, the left side wall or the right side wall of the delivery passage may be a visible structure formed by a limiting component, a limiting structure, a housing wall surface, etc., or a non-visible structure that actually exists. For instance, by controlling the delivery manner, speed, direction of the delivery wheel/roller, a reaching range of the playing cards may be limited to a specific range in the delivery passage. The left and right boundaries of the specific range are regarded as the left side wall or the right side wall of the delivery passage.

As shown in FIG. 19, in this embodiment, a first sensor 4235, a second sensor 4236, and a third sensor 4237 are sequentially installed on the delivery top portion wall 4218 or the delivery bottom portion wall 4204 of the delivery passage in an advancing direction of the playing cards. The first sensor 4235 and the third sensor 4237 may be used together to detect the length and distance of covering of the playing cards in the delivery passage at the same time to determine whether there are multiple overlapping playing cards. If the first sensor 4235 and the third sensor 4237 are blocked at the same time (playing cards are detected), it is determined that two partially overlapping playing cards enter the delivery passage. The card dealing motor 4220 reverses, returns the playing cards to the card storage box 41, allows the playing cards to re-enter, and separates the cards.

In the case that a playing card is delivered forwards along the width side in the card dealing device (that is, the width of the delivery passage is close to the width of the playing card), a distance between the first sensor 4235 and the third sensor 4237 is 2 mm to 3 mm greater than the length of the playing card.

In the case that a playing card is delivered forwards along the length side in the card dealing device (that is, the width of the delivery passage is close to the length of the playing card), the distance between the first sensor 4235 and the third sensor 4237 is 2 mm to 3 mm greater than the width of the playing card.

The second sensor 4236 is disposed between the first sensor 4235 and the third sensor 4237, and when the second sensor 4236 is blocked (a playing card is detected), a card turning motor 4230 is required to be activated for card turning according to needs. The second sensor 4236 may also be used together with the first sensor 4235 and the third sensor 4237 to assist in determining whether there are multiple partially overlapping playing cards.

In this way, after a single playing card separated by the poker card distributing mechanism passes through the first sensor, the camera takes pictures for front and back identification. When the playing card continues to move forwards along the passage to the second sensor position, according to the identification result, the poker card turning mechanism is controlled whether to turn the playing card. If the first sensor is blocked first until the third sensor is blocked at the same time (that is, playing cards are continuously detected), it means that two playing cards partially overlap and enter the delivery passage. The card dealing motor starts to reverse, and the playing cards that enter a card-traveling passage are returned to the card storage box to separate the single cards again, so as to ensure the accuracy of the number of cards to be distributed.

The image identification method is adopted to identify the front and back of playing cards. Due to the uncertainty of the pattern on the back of playing cards, there is a problem of misidentification, and therefore, it is preferable to use a learning mode to identify the front and back of a playing card. In this way, it is possible to perform identification learning on the playing cards put into the poker machine by setting the learning mode, so as to improve the efficiency and accuracy of identification performed by the poker machine on the playing cards.

The learning mode may be automatic coding or a convolutional neural network. The neural network does not need a mathematical model. In fact, a feature pattern is taken for comparison, and if such comparison matches, comparison of other positions or the entire image is activated. This mode requires a lot of memory and a powerful CPU. Therefore, the learning mode of deep automatic coding is preferably to be adopted. That is, a mathematical model (encoder) is formulated first, an input pattern is sampled in multiple layers, abstract feature information is extracted, the encoder is used to generate a feature code, and a certain number of samples are used to correct the feature code.

In this embodiment, the method of identifying the front and back of a playing card in the learning mode is to sample the back patterns or the front character patterns of multiple playing cards to generate a feature code and save the feature code. This feature code is then used to match a compared pattern to identify the front and back of the playing card.

In a preferred embodiment, a learning mode and a card playing mode are configured in the poker machine. In the learning mode, multiple playing cards are uniformly placed face down or with the reverse side facing down (e.g., a new deck of playing cards with the same front and back sides). The poker machine samples the back patterns or the front character patterns of the multiple playing cards to generate a feature code and saves the feature code. In the card playing mode, the poker machine obtains the back patterns or the front character patterns of these playing cards, uses this feature code to match the compared patterns to identify the front and back of the playing cards, and controls whether the poker card turning mechanism turns the playing cards according to the identification result.

Figure 11:
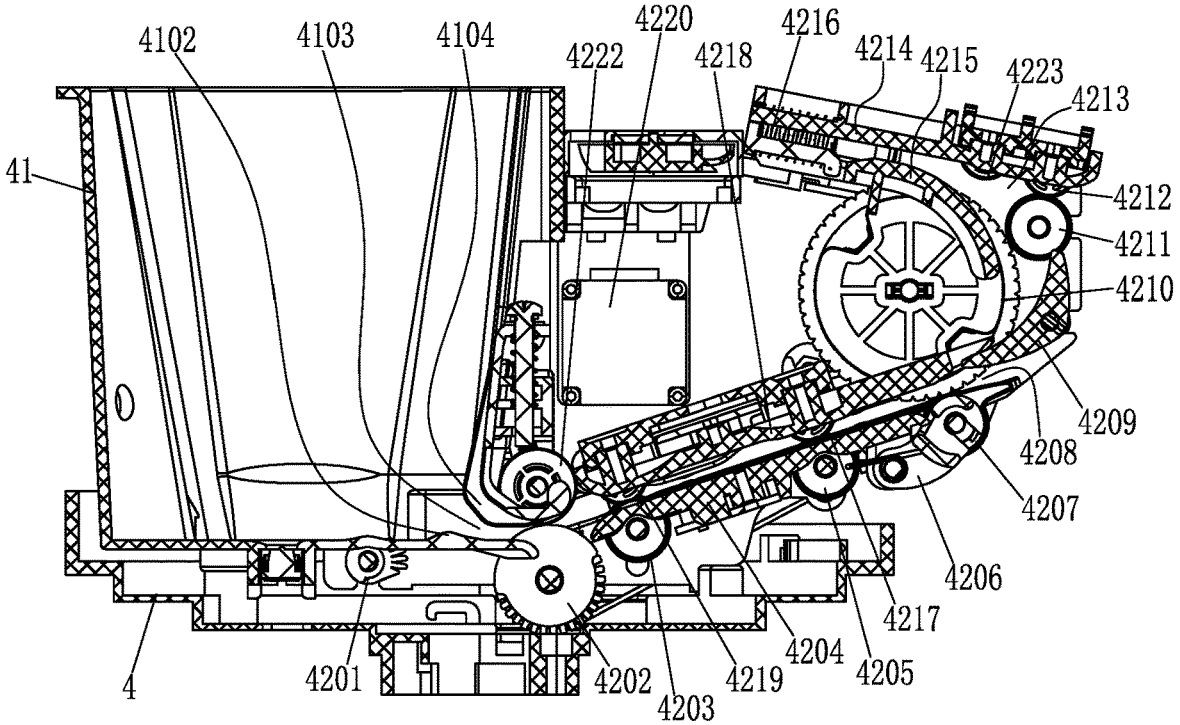
FIG. 11 is a second cross-sectional view of the card dealer (performing direct card distributing) according to an embodiment of the disclosure.
Figure 12:
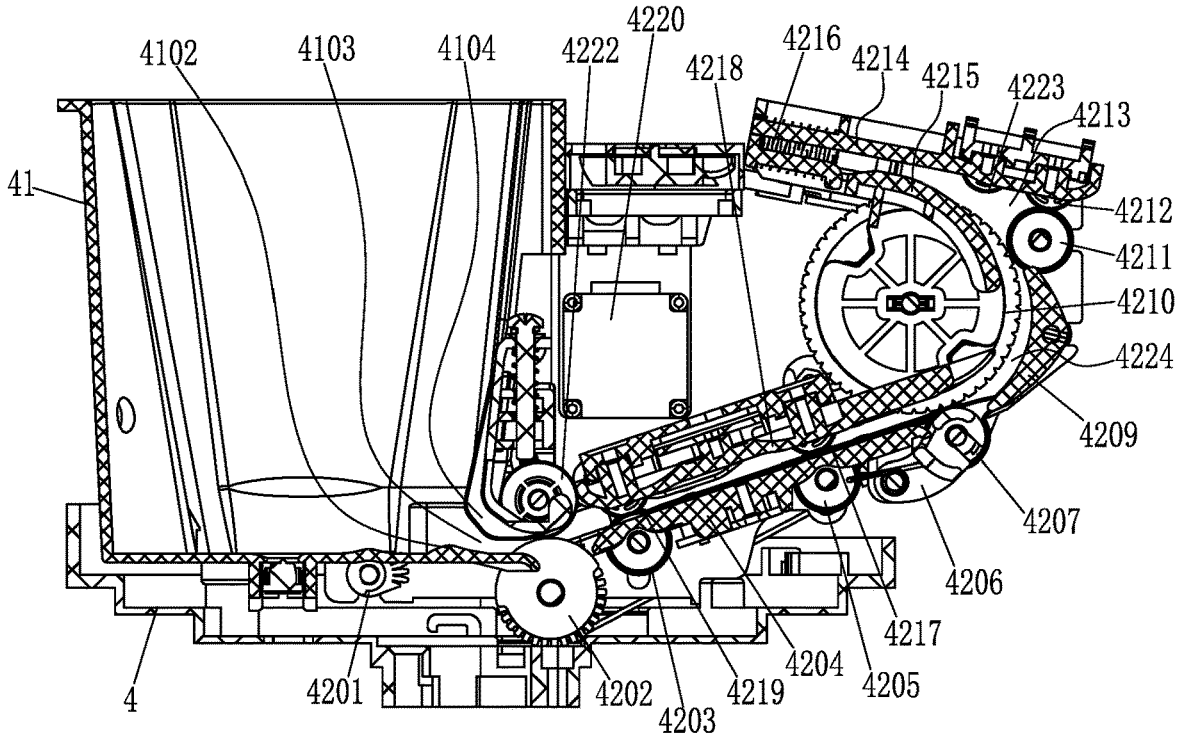
FIG. 12 is a third cross-sectional view of the card dealer (performing card distributing after card turning) according to an embodiment of the disclosure.
Figure 15:
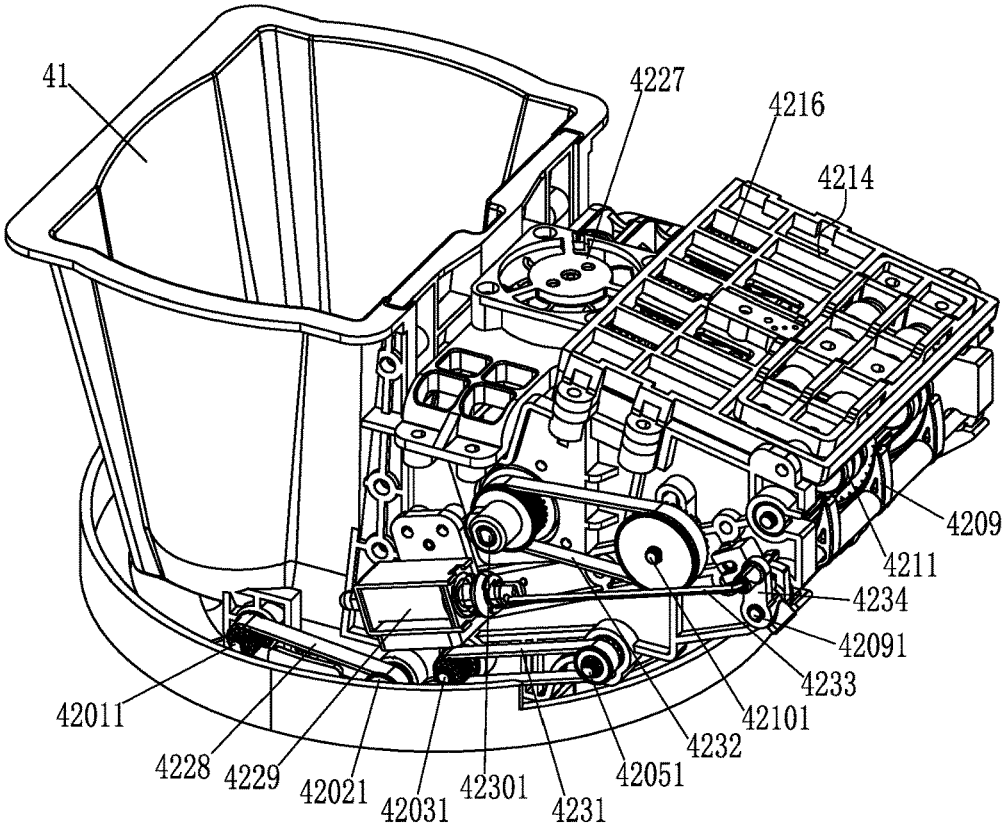
FIG. 15 is a second perspective view of the card dealer according to an embodiment of the disclosure.

As shown in FIG. 9 to FIG. 12, the poker card turning mechanism includes a first card discharge pressing wheel 4207, a card turning wheel 4210, a card turning pressing wheel 4211, and a second card discharge pressing wheel 4212. The card turning wheel 4210 is a driving wheel and is driven to rotate by the card turning motor 4230 (as shown in FIG. 15, a card turning motor shaft 42301 and a card turning wheel shaft 42101 are transmitted and connected through a card turning transmission belt 4232). The first card discharge pressing wheel 4207, the card turning pressing wheel 4211, and the second card discharge pressing wheel 4212 are all driven wheels. The first card discharge pressing wheel 4207 and the card turning pressing wheel 4211 are in rolling contact with the card turning wheel 4210, and the second card discharge pressing wheel 4212 and the card turning pressing wheel 4211 are in rolling contact. A first card discharging passage 4208 is formed between the card turning wheel 4210 and the first card discharge pressing wheel 4207, a card turning passage 4224 is formed between the card turning wheel 4210 and the card turning pressing wheel 4211, and a second card discharging passage 4213 is formed between the card turning pressing wheel 4211 and the second card discharge pressing wheel 4212. The card turning wheel 4210 is installed on an inner side of the card turning passage 4224 and is located between the first card discharging passage 4208 and the second card discharging passage 4213. The card turning passage 4224 extends along part of an arc circumference of the card turning wheel 4210 from one side of the card turning wheel 4210 close to the first card discharging passage 4208 to the other side of the card turning wheel 4210 away from the first card discharging passage 4208 and is configured to open or close the card turning passage 4224 or a card turning component 4209 of the first card discharging passage 4208 disposed at one end outside the card turning passage 4224 close to the first card discharging passage 4208. An end of the card turning passage 4224 away from the first card discharging passage 4208 is provided with a card pushing component 4216. The second card discharging passage 4213 is disposed at a position opposite to the card pushing component 4216 outside the card turning passage 4224. The card turning component 4209 is driven to swing by the card turning drive mechanism to open or close the card turning passage 4224 or the first card discharging passage 4208. As shown in FIG. 11, when the card turning component 4209 closes the card turning passage 4224 or opens the outlet of the first card discharging passage 4208, the card feeding passage 4103, the delivery passage, and the first card discharging passage 4208 are connected in sequence. The playing cards are sent out from the first card discharging passage 4208 onto the card receiving positions of the card receptor 2. As shown in FIG. 12, when the card turning component 4209 opens the card turning passage 4224 and closes the outlet of the first card discharging passage 4208, the card feeding passage 4103, the delivery passage, the first card discharging passage 4208, the card turning passage 4224, and the second card discharging passage 4213 are connected in sequence. The playing cards are blocked by the card turning component 4209 after being sent out from the first card discharging passage 4208, are turned to enter the card turning passage 4224, and are sent to the end of the card turning passage 4224 by the card turning wheel 4210 and the card turning pressing wheel 4211. The front ends of the playing cards abut against the card pushing component 4216, and after the back ends of the playing cards pass through the card turning pressing wheel 4211, the playing cards become flat again. Under the pushing force of the card pushing component 4216, the back ends of the playing cards first enter the second card discharging passage 4213 and are sent out to the card receiving positions of the card receptor 2 by the card turning pressing wheel 4211 and the second card discharge pressing wheel 4212. In this way, through the card turning passage, the passing playing cards are turned back and forth by 180°, and the turning of the front and back of the playing cards is thereby accomplished.

Note that in other embodiments of the disclosure, the first card discharging passage 4208 and the second card discharging passage 4213 may not be directly connected to the outlets of the card receiving positions of the card receptor 2. That is, behind the first card discharging passage 4208 and/or the second card discharging passage 4213, one or more passages (or delivery wheels/delivery rollers) for continuous delivery of the playing cards may be provided to send the playing cards to the card receiving positions of the card receptor 2.

Each of the card turning wheel 4210, the first card discharge pressing wheel 4207, the card turning pressing wheel 4211, and the second card discharge pressing wheel 4212 may be a roller part or may be formed by a plurality of wheel-shaped parts arranged on a same shaft. In this embodiment, the card turning wheel 4210, the first card discharge pressing wheel 4207, the card turning pressing wheel 4211, and the second card discharge pressing wheel 4212 all include multiple wheels mounted on their respective shafts. The card turning component 4209 may also include a plurality of components installed on the same rotating shaft, and the card turning component 4209 and the card turning wheel 4210 are disposed in an alternating manner, so that a simple structure is provided, and convenient and matching installation are achieved. A rubber ring may be installed on each of the card turning wheel 4210, the first card discharge pressing wheel 4207, the card turning pressing wheel 4211, and/or the second card discharge pressing wheel 4212 to increase the friction with the playing cards.

Figure 24:
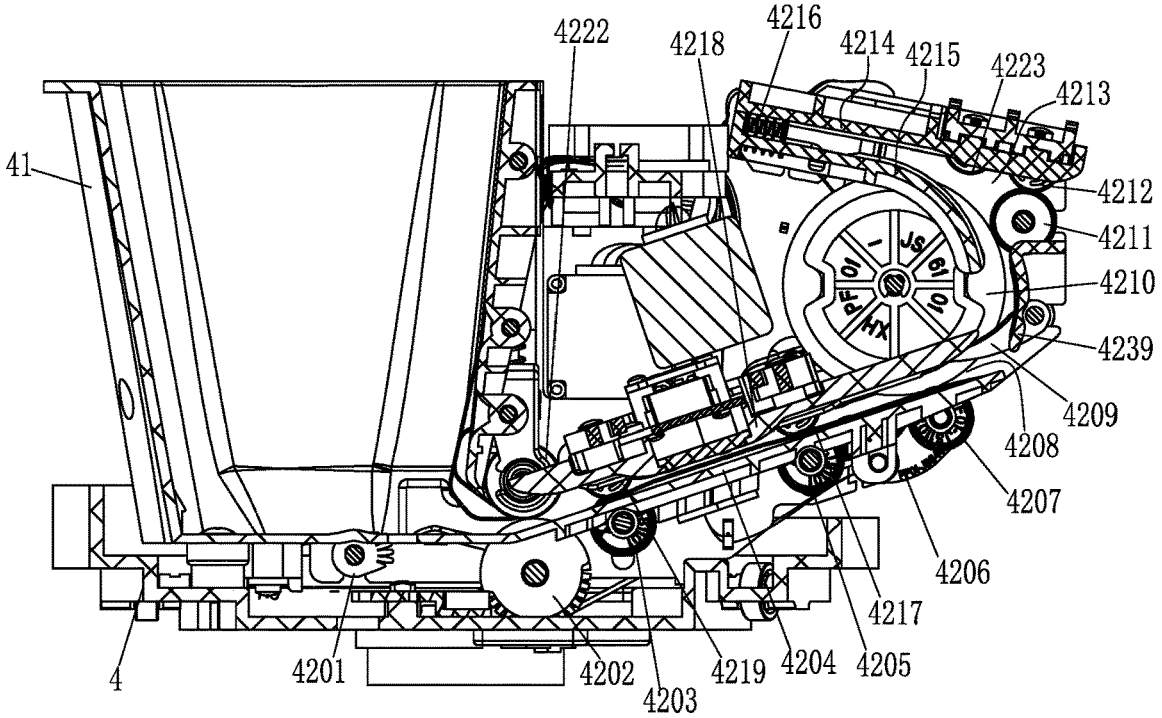
FIG. 24 is a first cross-sectional view of the card dealer (performing direct card distributing) according to another embodiment of the disclosure.
Figure 25:
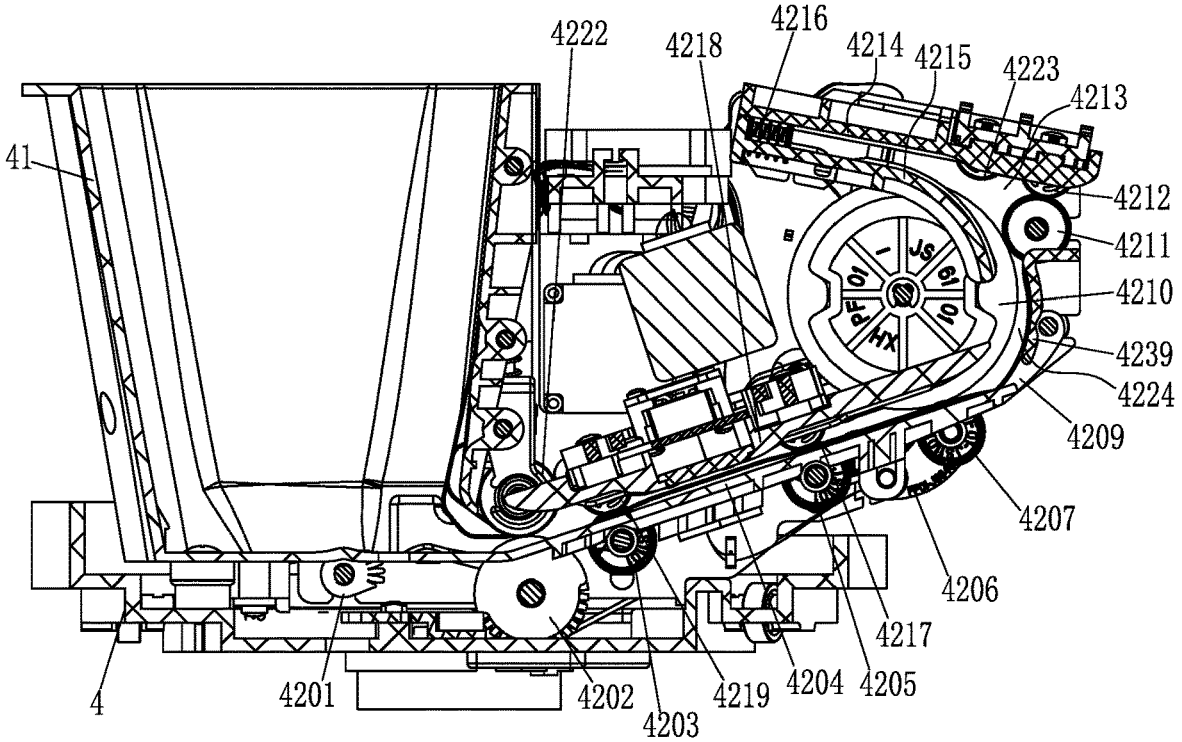
FIG. 25 is a second cross-sectional view of the card dealer (performing card distributing after card turning) according to another embodiment of the disclosure.
Figure 26:
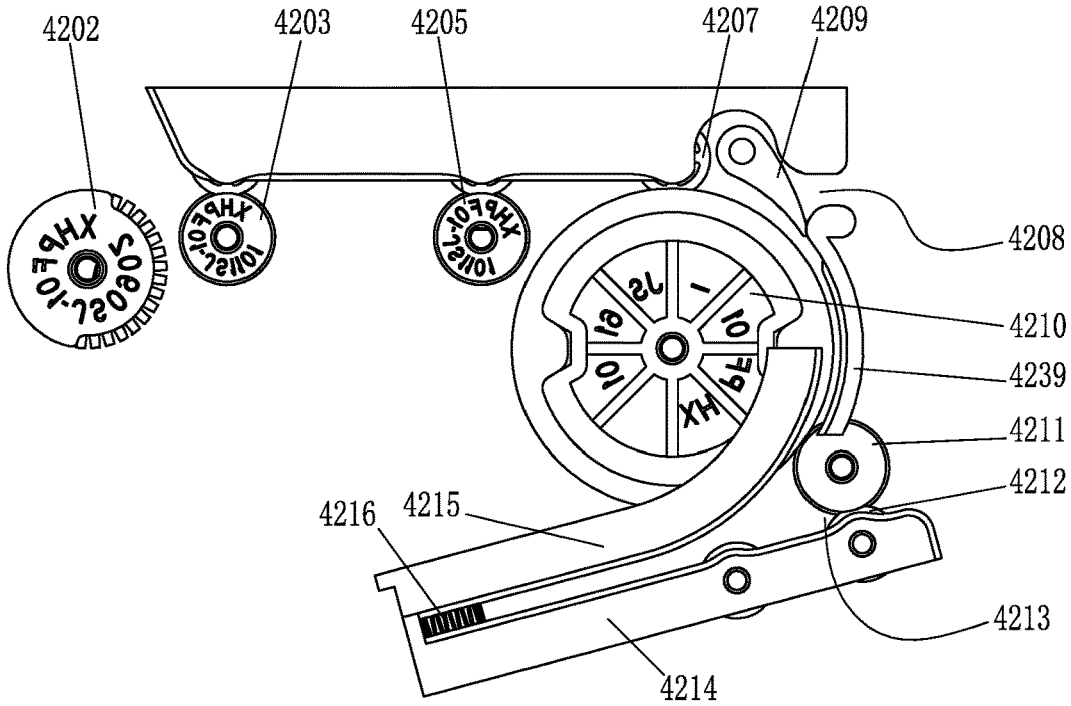
FIG. 26 is a schematic view of the card dealer (performing card distributing after card turning) according to still another embodiment of the disclosure.

In this embodiment, as shown in FIG. 11 to FIG. 14, the card turning passage 4224 includes a card turning passage inner side wall 4215, and a swing center (card turning shaft 42091) of the card turning component 4209 is located at a center position of the card turning component 4209. As such, two swing end portions are formed on both sides of the swing center, and an inner side of the card turning component 4209 is shaped as an arc shape corresponding to an outer circumference of the card turning wheel 4210. In this way, the card turning component 4209 may function to block direction turning, and the card turning component 4209 may further act as a card turning passage outer side wall, so that a specific card turning passage outer side wall is not required to be disposed. In some other embodiments, as shown in FIG. 24, FIG. 25, and FIG. 26, the swing center (card turning shaft 42091) of the card turning component 4209 is located at one end thereof, and a specific outer wall 4239 of the card turning passage is required to be disposed to ensure that the playing cards pass smoothly in the card turning passage 4224.

In this embodiment, the card turning passage 4224 and the second card discharging passage 4213 are disposed above the first card discharging passage 4208 (i.e., the card turning wheel 4210, the card turning pressing wheel 4211, and the second card discharge pressing wheel 4212 are located above the first card discharge pressing wheel 4207). In this way, configuration of heights of the card dealer as well as the poker machine is reasonable, the model is thin, and an increasing number of cards may be stored. Certainly, if space permits, the card turning passage 4224 and the second card discharging passage 4213 may be disposed below the first card discharging passage 4208 (i.e., the card turning wheel 4210, the card turning pressing wheel 4211, and the second card discharge pressing wheel 4212 are located below the first card discharge pressing wheel 4207), as shown in FIG. 26.

In order to prevent a playing card from getting stuck close to the side wall in the card turning passage 4224, and to ensure that the playing card may enter the second card discharging passage 4213 between the card turning pressing wheel 4211 and the second card discharge pressing wheel 4212, a transition wheel 4223 is disposed on a side of the second card discharge pressing wheel frame 4214 provided with the second card discharge pressing wheel 4212 close to the card turning wheel 4210 to guide the playing card to be located between the card turning pressing wheel 4211 and the second card discharge pressing wheel 4212.

In order to ensure the delivery pressure and to avoid slipping, the first card discharge pressing wheel 4207 and/or the card turning pressing wheel 4211 are/is given a tendency to press the card turning wheel 4210 preferably through respective enabling mechanisms, and the second card discharge pressing wheel 4212 is given the tendency to press the card turning pressing wheel 4211 preferably through an enabling mechanism. Each of these enabling mechanisms may be an elastic component such as a spring, an elastic piece, an elastic ring, or an elastic shaft or may also be an elastic enabling mechanism formed by a plurality of components. In this embodiment, the first card discharge pressing wheel 4207 is rotatably installed on a first card discharge pressing wheel frame 4206. The first card discharge pressing wheel frame 4206 is hingedly connected to a delivery bottom portion wall 4204 of the delivery passage, and a torsion spring is sleeved on a hinge connection shaft to make the first card discharge pressing wheel 4207 press the card turning wheel 4210. An elastic rubber ring is installed on the card turning pressing wheel 4211 to be pressed with the card turning wheel 4210. The second card discharge pressing wheel 4212 is installed on a second card discharge pressing wheel frame 4214 through an elastic shaft to press the card turning pressing wheel 4211. In this way, convenient installation is achieved, and a simple and reliable structure is provided.

The card turning drive mechanism driving the card turning component 4209 to open or close the first card discharging passage 4208 (opening the card turning passage 4224) may be implemented by a motor through a deceleration mechanism or a transmission mechanism. In this embodiment, as shown in FIG. 15, an electromagnet 4229 is adopted for driving. A crank 4234 is fixed to an end of a card turning shaft 42091 of the card turning component 4209, and a swing end of the crank 4234 is connected to a movable end of the electromagnet 4229 through a connecting rod 4233. In this way, when the card turning component 4209 needs to be moved, the electromagnet 4229 pulls the card turning component 4209 to swing through the connecting rod 4233 and the crank 4234. Because the card turning action is performed based on the result of the identification of the front and back of the playing cards by the camera, which is selective and intermittent, an electromagnet structure provided by this embodiment is reasonable and requires low manufacturing costs.

The card pushing component 4216 may be an elastic component such as a spring, an elastic piece, and an elastic rubber band or may also be an elastic enabling mechanism formed by a plurality of components. In this embodiment, the card pushing component 4216 is a plurality of springs arranged at the end of the passage. In this way, a simple structure is provided, and convenient installation is accomplished.

In another alternative embodiment of the poker card turning mechanism, the card turning passage 4224 is directly connected to the card storage box 41, and the second card discharging passage 4213, the second card discharge pressing wheel 4212, and the card pushing component 4216 are not disposed. The turned playing cards are directly returned to the card storage box, are allowed to re-enter, and are redistributed. That is, the poker card turning mechanism includes a first card discharge pressing wheel, a card turning wheel, and a card turning pressing wheel. The card turning wheel is a driving wheel and is driven to be turned by a card turning motor, and the first card discharge pressing wheel and the card turning pressing wheel are both driven wheels. The first card discharge pressing wheel and the card turning pressing wheel are in rolling contact with the card turning wheel. A first card discharging passage is formed between the card turning wheel and the first card discharge pressing wheel, and a card turning passage is formed between the card turning wheel and the card turning pressing wheel. The card turning wheel is installed on an inner side of the card turning passage, and the card turning passage extends along part of an arc circumference of the card turning wheel from one side of the card turning wheel close to the first card discharging passage to the other side of the card turning wheel away from the first card discharging passage. The end of the card turning passage is connected to the space of the card storage box and is configured to open or close the card turning passage or a card turning component of the first card discharging passage disposed at one end outside the card turning passage close to the first card discharging passage. The card turning component is driven to swing by the card turning drive mechanism to open or close the card turning passage or the first card discharging passage. When the card turning component closes the card turning passage or opens the outlet of the first card discharging passage, the card feeding passage, the delivery passage, and the first card discharging passage are connected in sequence. The playing cards are sent out from the first card discharging passage onto the card receiving positions of the card receptor. When the card turning component opens the card turning passage and closes the outlet of the first card discharging passage, the card feeding passage, the delivery passage, the first card discharging passage, and the card turning passage are connected in sequence. The playing cards are blocked by the card turning component after being sent out from the first card discharging passage, are turned to enter the card turning passage, and are sent to the end of the card turning passage by the card turning wheel and the card turning pressing wheel (a plurality of delivery wheels and pressing wheels thereof may be further disposed between the card storage box and the card turning wheel for delivery of the playing cards) to enter the card storage box. In this way, through the card turning passage, the passing playing cards are turned back and forth, and the turning of the front and back of the playing cards is thereby accomplished. Description of other structures is the same as above. In this structure, the depth of the card storage box may be designed to be shallow and the height of the poker machine may be designed to be low, but the card distributing efficiency is low and high the manufacturing costs are required.

The above-mentioned poker machine includes the card receptor 2 and the card dealer. The card dealer is installed in the center of the card receptor 2 and is driven to rotate relative to the card receptor 2 by the rotating drive mechanism, and the card receiving positions are arranged on the card receptor 2 around the card dealer. The card dealer includes the card storage box 41 and the card dealing device 42, the card storage box 41 and the card dealing device 42 are respectively located on the left and right sides of the card dealer seat 4, and one side of the bottom portion of the card storage box 41 communicates with the card feeding passage of the card dealing device 42. The card dealing device 42 includes the poker card distributing mechanism configured to separate a deck of playing cards sorted in the card storage box into playing cards one by one and to send the playing cards to delivery mechanism, the delivery mechanism configured to identify the front and back of the playing cards and to deliver the playing cards to the poker card turning mechanism, and the poker card turning mechanism configured to turn the playing cards as needed and send the playing cards to each card receiving position on the card receptor 2.

As described above, the poker card sorting method of the poker machine includes the following steps.

1) Placing a deck of sorted playing cards into a card storage box.

2) Separating the deck of sorted playing cards in the card storage box into playing cards one by one and sending the playing cards to a delivery mechanism by a poker card distributing mechanism.

3) Identifying the front and back of the playing cards and delivering the playing cards to a poker card turning mechanism by the delivery mechanism.

4) Turning the playing cards as needed and sending the playing cards to each card receiving position on a card receptor by the poker card turning mechanism.

In the description of the specification, descriptions with reference to the terms such as "one embodiment", "some embodiments", "examples", "specific examples", or "some examples" etc. means that the specific features, structures, materials, or characteristics described in combination with the embodiment(s) or example(s) are included in at least one embodiment or example of the disclosure. In the specification, the schematic representation of the above-mentioned terms does not necessarily refer to the same embodiment or example. Further, the described specific features, structures, materials, or characteristics may be combined in any one or more embodiments or examples in a suitable manner.

Although the embodiments of the disclosure have been shown and described above, it can be understood that the above-mentioned embodiments are exemplary and should not be construed as limiting the disclosure. A person having ordinary skill in the art may make changes, corrections, substitutions, and modifications to the above-mentioned embodiments within the scope of the disclosure without departing from the principle and purpose of the disclosure, and any simple corrections, equivalent changes, and modifications made to the above embodiments based on the technical essence of the disclosure still fall within the scope of the technical solutions of the disclosure.

What is claimed is:

1. A poker card turning mechanism of a poker machine, the poker card turning mechanism comprising a first card discharge pressing wheel, a card turning wheel, a card turning pressing wheel, and a second card discharge pressing wheel, wherein the card turning wheel is a driving wheel and is driven to be turned by a card turning motor, the first card discharge pressing wheel, the card turning pressing wheel, and the second card discharge pressing wheel are all driven wheels, the first card discharge pressing wheel and the card turning pressing wheel are in rolling contact with the card turning wheel, the second card discharge pressing wheel and the card turning pressing wheel are in rolling contact, a first card discharging passage is formed between the card turning wheel and the first card discharge pressing wheel, a card turning passage is formed between the card turning wheel and the card turning pressing wheel, a second card discharging passage is formed between the card turning pressing wheel and the second card discharge pressing wheel, the card turning wheel is installed on an inner side of the card turning passage and is located between the first card discharging passage and the second card discharging passage, the card turning passage extends along part of an arc circumference of the card turning wheel from one side of the card turning wheel close to the first card discharging passage to the other side of the card turning wheel away from the first card discharging passage, a card turning component configured to open or close an outlet of the first card discharging passage is disposed outside the card turning passage, an end of the card turning passage away from the first card discharging passage is provided with a card pushing component, the second card discharging passage is disposed at a position opposite to the card pushing component outside the card turning passage, and the card turning component is driven by a card turning drive mechanism to open or close the first card discharging passage, when the card turning component opens the outlet of the first card discharging passage, a card feeding passage, a delivery passage, and the first card discharging passage are connected in sequence and a playing card is sent out from the first card discharging passage, when the card turning component opens the card turning passage and closes the outlet of the first card discharging passage, the card feeding passage, the delivery passage, the first card discharging passage, the card turning passage, and the second card discharging passage are connected in sequence, and the playing card is sent out from the second card discharging passage.

2. The poker card turning mechanism of the poker machine according to claim 1, wherein each of the card turning wheel, the first card discharge pressing wheel, the card turning pressing wheel, and the second card discharge pressing wheel is a roller part or is formed by a plurality of wheel-shaped parts installed on a same shaft.

3. The poker card turning mechanism of the poker machine according to claim 1, wherein the card turning component is driven to swing by the card turning drive mechanism to open or close the first card discharging passage, a swing center of the card turning component is located at a center position or an end portion of the card turning component, and an inner side of the card turning component is shaped as an arc shape corresponding to an outer circumference of the card turning wheel.

4. The poker card turning mechanism of the poker machine according to claim 1, wherein the card turning passage and the second card discharging passage-are disposed above or below the first card discharging passage.

5. The poker card turning mechanism of the poker machine according to claim 1, wherein the card turning drive mechanism driving the card turning component to open or close the outlet of the first card discharging passage is implemented by a motor through a deceleration mechanism or a transmission mechanism.

6. The poker card turning mechanism of the poker machine according to claim 1, wherein the card turning drive mechanism driving the card turning component to open or close the outlet of the first card discharging passage is an electromagnet, a crank is fixed to an end of a card turning shaft of the card turning component, a swing end of the crank is connected to a movable end of the electromagnet through a connecting rod, such that the electromagnet pulls the card turning component to swing through the connecting rod and the crank when the card turning component needs to be moved.

7. The poker card turning mechanism of the poker machine according to claim 1, wherein the first card discharge pressing wheel and/or the card turning pressing wheel elastically press the card turning wheel through respective enabling mechanisms, the card pushing component is an elastic component including a spring, an elastic piece, and an elastic rubber band or is an elastic enabling mechanism formed by a plurality of components, the first card discharge pressing wheel is rotatably installed on a first card discharge pressing wheel frame, the first card discharge pressing wheel frame is hingedly connected to a delivery bottom portion wall of the delivery passage, a torsion spring is sleeved on a hinge connection shaft to make the first card discharge pressing wheel press the card turning wheel, the second card discharge pressing wheel is installed on a second card discharge pressing wheel frame through an elastic shaft to press the card turning pressing wheel, and a transition wheel is disposed on a side of the second card discharge pressing wheel frame close to the card turning wheel to guide the playing card to be located between the card turning pressing wheel and the second card discharge pressing wheel.

8. A card dealer of a poker machine, comprising the poker card turning mechanism according to claim 1.

9. A poker machine, comprising the card dealer according to claim 8.

10. A poker card sorting method of a poker machine, the method comprising:

placing a deck of sorted playing cards into a card storage box of the poker machine, wherein the poker machine comprises:

a poker card turning mechanism, the poker card turning mechanism comprises a first card discharge pressing wheel, a card turning wheel, a card turning pressing wheel, and a second card discharge pressing wheel, wherein the card turning wheel is a driving wheel and is driven to be turned by a card turning motor, the first card discharge pressing wheel, the card turning pressing wheel, and the second card discharge pressing wheel are all driven wheels, the first card discharge pressing wheel and the card turning pressing wheel are in rolling contact with the card turning wheel, the second card discharge pressing wheel and the card turning pressing wheel are in rolling contact, a first card discharging passage is formed between the card turning wheel and the first card discharge pressing wheel, a card turning passage is formed between the card turning wheel and the card turning pressing wheel, a second card discharging passage is formed between the card turning pressing wheel and the second card discharge pressing wheel, the card turning wheel is installed on an inner side of the card turning passage and is located between the first card discharging passage and the second card discharging passage, the card turning passage extends along part of an arc circumference of the card turning wheel from one side of the card turning wheel close to the first card discharging passage to the other side of the card turning wheel away from the first card discharging passage, a card turning component configured to open or close an outlet of the first card discharging passage is disposed outside the card turning passage, an end of the card turning passage away from the first card discharging passage is provided with a card pushing component, the second card discharging passage is disposed at a position opposite to the card pushing component outside the card turning passage, and the card turning component is driven by a card turning drive mechanism to open or close the first card discharging passage, when the card turning component opens the outlet of the first card discharging passage, a card feeding passage, a delivery passage, and the first card discharging passage are connected in sequence and a playing card is sent out from the first card discharging passage, and when the card turning component opens the card turning passage and closes the outlet of the first card discharging passage, the card feeding passage, the delivery passage, the first card discharging passage, the card turning passage, and the second card discharging passage are connected in sequence, and the playing card is sent out from the second card discharging passage;

separating the deck of sorted playing cards in the card storage box into playing cards one by one and sending the playing cards to a delivery mechanism by a poker card distributing mechanism;

identifying the front and back of the playing cards and delivering the playing cards to the poker card turning mechanism of the poker machine by the delivery mechanism; and turning the playing cards as needed and sending the playing cards to each card receiving position on a card receptor by the poker card turning mechanism.

* * * * *